US009323169B2

(12) United States Patent
Tyagi et al.

(10) Patent No.: US 9,323,169 B2
(45) Date of Patent: *Apr. 26, 2016

(54) PREPARING COLOR TONER IMAGES WITH METALLIC EFFECT

(71) Applicant: EASTMAN KODAK COMPANY, Rochester, NY (US)

(72) Inventors: Dinesh Tyagi, Fairport, NY (US); Kevin D. Lofftus, Fairport, NY (US); Louise Granica, Victor, NY (US); Richard George Allen, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 38 days.

This patent is subject to a terminal disclaimer.

(21) Appl. No.: 13/873,540

(22) Filed: Apr. 30, 2013

(65) Prior Publication Data

US 2013/0295351 A1 Nov. 7, 2013

Related U.S. Application Data

(63) Continuation-in-part of application No. 13/462,111, filed on May 2, 2012, now abandoned.

(51) Int. Cl.
*G03G 9/09* (2006.01)
*G03G 13/20* (2006.01)
(Continued)

(52) U.S. Cl.
CPC ..... *G03G 13/20* (2013.01); *G03G 9/0819* (2013.01); *G03G 9/09708* (2013.01); *G03G 9/09725* (2013.01); *G03G 15/6585* (2013.01); *Y10T 428/24901* (2015.01)

(58) Field of Classification Search
CPC ..... G03G 9/09; G03G 9/0902; G03G 9/0926
USPC ..... 430/123.5
See application file for complete search history.

(56) References Cited

U.S. PATENT DOCUMENTS 4,220,675 A 9/1980 Imazaki
5,180,650 A 1/1993 Sacripante et al.
(Continued)

FOREIGN PATENT DOCUMENTS

JP 10-268569 10/1998
JP 2007-114618 * 5/2007
WO WO 2009/135784 11/2009

OTHER PUBLICATIONS

D. Tyagi, "Preparing Dry Toner Particles for Metallic Effect," U.S. Appl. No. 13/462,077, filed May 2, 2012.
(Continued)

*Primary Examiner* — Peter Vajda
*Assistant Examiner* — Olatunji Godo
(74) *Attorney, Agent, or Firm* — J. Lanny Tucker

(57) ABSTRACT

A color toner image with a metallic effect can be prepared by forming one or more latent images and developing them with metallic dry toner particles and color toner particles. The developed color toner image can be transferred to a receiver material, and fixed to provide a color toner image with a metallic effect. The metallic dry toner particles have a polymeric binder phase and non-conductive metal oxide particles dispersed therein. Before fixing, the metallic dry toner particle has a mean volume weighted diameter ($D_{vol}$) 15-40 μm and the non-conductive metal oxide particles are present in an amount of at least 20-50 weight % based on total metallic dry toner particle weight. The ratio of the metallic dry toner particle $D_{vol}$ to the average equivalent circular diameter (ECD) of the non-conductive metal oxide particles in the metallic dry toner particles is greater than 0.1 and up to and including 10.

18 Claims, 1 Drawing Sheet

(51) Int. Cl.

| | |
|---|---|
| ***G03G 15/00*** | (2006.01) |
| ***G03G 9/08*** | (2006.01) |
| ***G03G 9/097*** | (2006.01) |

(56) References Cited

U.S. PATENT DOCUMENTS

| | | | | |
|---|---|---|---|---|
| 5,298,356 | A | 3/1994 | Tyagi et al. | |
| 5,312,704 | A * | 5/1994 | Fuller et al. | 430/109.3 |
| 5,910,388 | A | 6/1999 | Ray et al. | |
| 6,033,820 | A | 3/2000 | Hayashi et al. | |
| 6,134,400 | A | 10/2000 | Higashi et al. | |
| 7,139,521 | B2 | 11/2006 | Ng et al. | |
| 7,326,507 | B2 | 2/2008 | Schulze-Hagenest et al. | |
| 7,955,772 | B2 | 6/2011 | Schuster et al. | |
| 2002/0018663 | A1 | 2/2002 | Furukawa et al. | |
| 2003/0059698 | A1 * | 3/2003 | Ebisu et al. | 430/108.6 |
| 2003/0087176 | A1 | 5/2003 | Ezenyilimba et al. | |
| 2003/0148203 | A1 * | 8/2003 | Suzuki et al. | 430/110.3 |
| 2005/0214666 | A1 * | 9/2005 | Schulze-Hagenest et al. | 430/108.2 |
| 2005/0287090 | A1 * | 12/2005 | Bujard | 424/63 |
| 2006/0135670 | A1 | 6/2006 | Richter et al. | |
| 2008/0159786 | A1 | 7/2008 | Tombs et al. | |
| 2008/0193868 | A1 * | 8/2008 | Schuster et al. | 430/108.2 |
| 2009/0142692 | A1 | 6/2009 | Vanbesien et al. | |
| 2009/0297970 | A1 * | 12/2009 | Tyagi et al. | 430/66 |
| 2010/0164218 | A1 | 7/2010 | Schulze-Hagenest et al. | |
| 2011/0118384 | A1 * | 5/2011 | Bugnon et al. | 523/171 |
| 2011/0160389 | A1 | 6/2011 | Bubat et al. | |
| 2011/0236698 | A1 | 9/2011 | Filou et al. | |
| 2011/0262654 | A1 | 10/2011 | Yates et al. | |
| 2011/0262858 | A1 | 10/2011 | Nair et al. | |
| 2012/0202021 | A1 | 8/2012 | Schulze-Hagenest et al. | |

OTHER PUBLICATIONS

D. Tyagi, "Preparing Toner Images with Metallic Effect," U.S. Appl. No. 13/462,094, filed May 2, 2012.

D. Tyagi, "Preparing Color Toner Images with Metallic Effect," U.S. Appl. No. 13/462,111, filed May 2, 2012.

D. Tyagi, et al. "Non-Porous Dry Toner Particles for Metallic Printed Effect," U.S. Appl. No. 13/462,031, filed May 2, 2012.

* cited by examiner

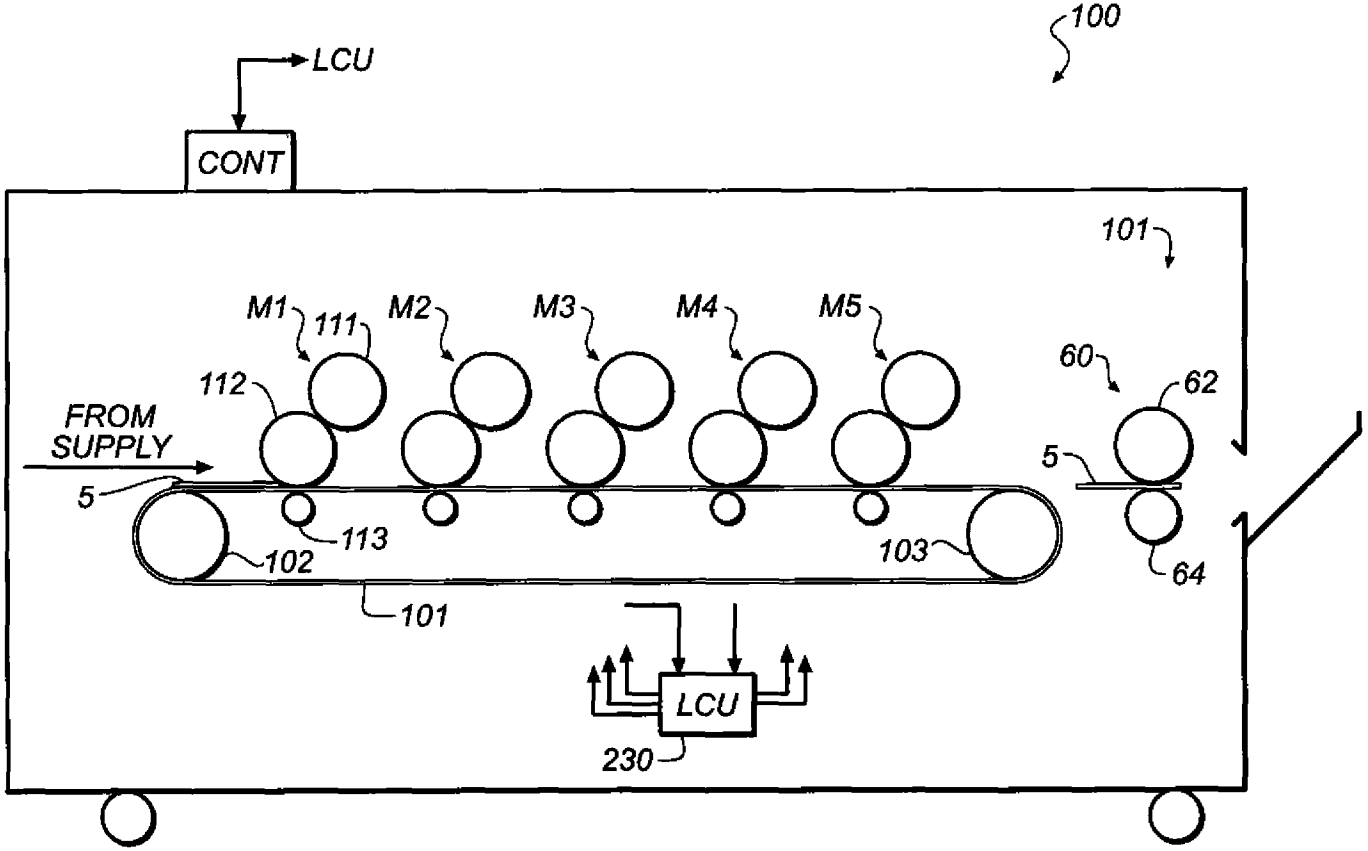
100
101
62
64
60
5
103
M5
M4
M3
M2
M1
111
112
113
102
101
LCU
230
LCU
CONT
FROM SUPPLY
5

PREPARING COLOR TONER IMAGES WITH METALLIC EFFECT

RELATED APPLICATION

This is a Continuation-in-part of commonly assigned U.S. Ser. No. 13/462,111 filed May 2, 2012 by Tyagi, Lofftus, Granica, and Allen, now abandoned.

FIELD OF THE INVENTION

This invention relates to a method for using metallic dry toner particles that are designed to provide a metallic effect in the preparation of color toner images particularly in electrophotography.

BACKGROUND OF THE INVENTION

One common method for printing images on a receiver material is referred to as electrophotography. The production of black-and-white or color images using electrophotography generally includes the producing a latent electrostatic image by uniformly charging a dielectric member such as a photoconductive substance, and then discharging selected areas of the uniform charge to yield an imagewise electrostatic charge pattern. Such discharge is generally accomplished by exposing the uniformly charged dielectric member to actinic radiation provided by selectively activating particular light sources in an LED array or a laser device directed at the dielectric member. After the imagewise charge pattern is formed, it is "developed" into a visible image using pigmented or non-pigmented marking particles (generally referred to as "toner particles") by either using the charge area development (CAD) or the discharge area development (DAD) method that have an opposite charge to the dielectric member and are brought into the vicinity of the dielectric member so as to be attracted to the imagewise charge pattern.

Thereafter, a suitable receiver material (for example, a cut sheet of plain bond paper) is brought into juxtaposition with the toner image developed with the toner particles in accordance with the imagewise charge pattern on the dielectric member, either directly or using an intermediate transfer member. A suitable electric field is applied to transfer the toner particles to the receiver material in the imagewise pattern to form the desired print image on the receiver material. The receiver material is then removed from its operative association with the dielectric member and subjected to suitable heat or pressure or both heat and pressure to permanently fix (also known as fusing) the toner image (containing toner particles) to form the desired image on the receiver material.

Plural toner particle images of, for example, different color toner particles respectively, can be overlaid with multiple toner transfers to the receiver material, followed by fixing of all toner particles to form a multi-color image in the receiver material. Toners that are used in this fashion to prepare multicolor images are generally Cyan (C), Magenta (M), Yellow (Y), and Black (K) toners containing appropriate dyes or pigments to provide the desired colors or tones.

It is also known to use special spot toners to provide additional colors that cannot be obtained by simply mixing the four "primary" toners. An example is a specially designed toner that provides a color spot or pearlescent effect.

With the improved print image quality that is achieved with the more recent electrophotographic technology, print providers and customers alike have been looking for ways to expand the use of images prepared using electrophotography. Printing processes serve not only to reproduce and transmit objective information but also to convey esthetic impressions, for example, for glossy books or pictorial advertizing. A significant problem is posed in the production of metallic hues that are imperfectly reproducible by a color mixture formed from the primary colors and black (such as CMYK noted above). A gold tone is particularly difficult to reproduce by means of such a color mixture. Common metallic pigments are typically conductive and not readily incorporated into toner particles without adversely affecting magnetic, electrical, or electrostatic properties.

Nonetheless, there have been proposals for incorporating metallic components in toner compositions. For example, U.S. Pat. No. 5,180,650 (Sacripante et al.) describes toner compositions that contain lightly colored metallic components such as copper, silver, or gold for example that are provided with an overcoat comprising a metal halide. However, the appearance of images obtained using metal halides can be adversely affected by oxidation (for example tarnishing or toning of metals) promoted by those metal halides making the metallic quality to be unattractive or it disappear completely.

Further, when metallic components are incorporated into toner particles using known manufacturing procedures, the metallic flakes are generally randomly oriented within the particles. This random orientation leads to a loss of metallic hue and causes a dark appearance when such toner particles are fixed (fused) to a receiver material using heated rollers.

More recently, there have been proposals to modify the surface of metallic flakes such that becomes hydrophobic and non-conductive, as described in U.S. Pat. No. 7,326,507 (Schulze-Hagenest et al.). Printing compositions in this publication provide metallic effects in which a metallic pigment is provided with coatings of silicate, titanate, or aluminate and an organic layer, and is then combined with polymeric toner particles. Thus, the metallic pigments are outside the toner particles and can become detached from those toner particles during manufacture or mixing during development, resulting in non-homogeneity in the toner composition that can result in transfer and cleaning problems.

These problems were addressed with porous toner particles that are described in U.S. Patent Application Publication 2011/0262858 (Nair et al.), which porous toner particles comprise encapsulated metallic or metal oxide flakes. Porous toner particles provide certain advantages but may not be useful in every application due to their porosity. Further, such dry toner particles, when prepared by the method described by Nair et al. are formed by coalescence of very small particles. This method limits the largest size that can be achieved for the formation of toner particles containing metallic pigments. It is desirable to not be so limited and to be able to provide larger dry toner particles containing metallic pigments to produce metallic appearance or luster in printed images.

There is a need to further improve metallic toner particles that provide metallic effects in toner images. Bronze and aluminum powders have been used as pigments to provide metallic effects but they do not disperse well in polymeric toner particles. Such pigments are also very fragile and easily broken during extrusion processes used to form polymeric toner particles. These pigments are also generally conductive and can adversely affect the charging abilities of the polymeric toner particles.

Printing processes for providing one or more color toner images are known, but it is also desired that such color toner images, including four-color toner images, be modified with a metallic effect. However, this has not been readily achieved using known metallic toner particles because it has been difficult to introduce metallic particles into known dry toner particles. There are various problems with known processes. For example, it has been difficult to provide suitable metallic effects in toner images because in order to have high reflecting surface area. Many reflective metallic particles are too easily broken into smaller particles during handling or manufacture of toner particles. If the metallic particle size can be maintained, the size of the toner particles must be larger than is normally used in the industry, but larger toner particles are more difficult to fix (fuse) on receiver materials because of the low thermal conductivity associated with larger toner particles.

There is a need to design suitable dry toner particles and a method of using them to provide an unlimited number of metallic effects in four-color toner images.

SUMMARY OF THE INVENTION

This invention provides a method for providing a color toner image with a metallic effect, the method comprising:

forming one or more latent images, developing the one or more latent images with metallic dry toner particles and non-metallic color toner particles to form a developed color toner image with a metallic effect, transferring the developed color toner image with a metallic effect to a receiver material to form a transferred developed color toner image with a metallic effect, and fixing the transferred developed color toner image with a metallic effect to the receiver material, wherein each metallic dry toner particle consists essentially of a polymeric binder phase and non-conductive metal oxide particles dispersed within the polymeric binder phase, wherein, before fixing:

(a) each metallic dry toner particle has a mean volume weighted diameter ($D_{vol}$) of at least 15 μm and up to and including 40 μm, (b) at least 50 weight % of the total non-conductive metal oxide particles within metallic dry toner particles have an aspect ratio of at least 5 and an ECD of at least 2 μm and up to and including 50 μm, (c) the non-conductive metal oxide particles are present in an amount of at least 15 weight % and up to and including 50 weight %, based on total metallic dry toner particle weight, (d) the ratio of the metallic dry toner particle $D_{vol}$ to the average equivalent circular diameter (ECD) of the non-conductive metal oxide particles in the metallic dry toner particles, before fixing, is greater than 0.1 and up to and including 10, (e) the non-conductive metal oxide particles consist essentially of (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 30 nm and up to and including 700 nm so that the total average dry thickness of all oxide layers is at least 30 nm and up to and including 1400 nm, and (f) at least one of the layers of an oxide of iron, chromium, silicon, titanium, or aluminum, forms the outermost layer of the non-conductive metal oxide particles.

In some embodiments, this method comprises:

forming the toner image that provides a metallic effect on the receiver material with the metallic dry toner particles, then forming a cyan, yellow, magenta, or black toner image over the toner image that provides a metallic effect, using the color toner particles, and fixing both the toner image that provides a metallic effect and the cyan, yellow, magenta, or black toner image to the receiver material.

In other embodiments, the method comprises:

forming a cyan, yellow, magenta, or black toner image on a receiver material, then forming the toner image that provides a metallic effect over the cyan, yellow, magenta, or black toner image, and fixing both the cyan, yellow, magenta, or black image and the toner image that provides a metallic effect to the receiver material.

Still again, the method of this invention can comprise:

forming, in any sequence, cyan, yellow, magenta, and black toner images on a receiver material, then forming the toner image that provides a metallic effect over the cyan, yellow, magenta, and black toner images, and fixing all of the cyan, yellow, magenta, and black toner images, and the toner image that provides a metallic effect to the receiver material.

In other embodiments, the method comprises:

forming the toner image that provides a metallic effect on the receiver material, then forming in any sequence, cyan, yellow, magenta, and black toner images over the toner image that provides a metallic effect, and fixing all of the cyan, yellow, magenta, and black toner images, and the toner image that provides a metallic effect to the receiver material.

Moreover, this method comprises:

forming in this sequence, cyan, yellow, and magenta toner images on the receiver material, then forming the toner image that provides a metallic effect over the cyan, yellow, and magenta toner images, then forming a black toner image over the toner image that provides a metallic effect and the cyan, yellow, and magenta toner images.

This invention also provides a printed receiver material provided by the method of this invention, comprising a printed image comprising fused metallic dry toner particles that provide a metallic effect and a fused color toner in the printed image, wherein, before fixing:

(a) each metallic dry toner particle has a mean volume weighted diameter ($D_{vol}$) of at least 15 μm and up to and including 40 μm, (b) at least 50 weight % of the total non-conductive metal oxide particles within metallic dry toner particles have an aspect ratio of at least 5 and an ECD of at least 2 μm and up to and including 50 μm, (c) the non-conductive metal oxide particles are present in an amount of at least 15 weight % and up to and including 50 weight %, based on total metallic dry toner particle weight, (d) the ratio of the metallic dry toner particle $D_{vol}$ to the average equivalent circular diameter (ECD) of the non-conductive metal oxide particles in the metallic dry toner particles, before fixing, is greater than 0.1 and up to and including 10, (e) the non-conductive metal oxide particles consist essentially of (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 30 nm and up to and including 700 nm so that the total average dry thickness of all oxide layers is at least 30 nm and up to and including 1400 nm, and (f) at least one of the layers of an oxide of iron, chromium, silicon, titanium, or aluminum, forms the outermost layer of the non-conductive metal oxide particles.

The metallic dry toner particles described herein are useful to provide metallic effects when used in combination with color toner images that do not contain non-conductive metal oxide particles. Thus, the metallic effects can be achieved when used to enhance the original color in multichromic toner images. For example, gold-like or gold-tone effects can be achieved using mica in the metallic dry toner particles, either when used in combination with color toner images especially composite CYMK color toner images. When silica particles are used, the metallic effect can exhibit "color travel" (different hues seen in the image when it is viewed from different angles), and when alumina particles are used, the metallic effect can be enhanced luster (sometimes known as "sparkle").

Further improvements can be achieved when the metal oxide particles are at least partially coated with a non-conductive metal oxide of iron, chromium, silicon, titanium, or aluminum as described below. Such metal oxide coatings provide certain hue based on the optical interference caused by the thickness of the coatings. Further, these metal oxide coatings provide thermal and mechanical stability of the non-conductive metal oxide particles dispersed within the polymeric binder phase and can also improve the electrostatic charging properties of the metallic dry toner particles.

Thus, the present invention is particularly useful to provide metallic effects in four-color toner images (for example, CYMK). The metallic effects can be provided over or under the four-color toner images. These metallic effects can be either transparent or opaque in nature. Thus surprisingly new color effects can be obtained, opening a very wide range of color image options for various purposes. Various amounts of the metallic dry toners providing metallic effects, or various amounts of individual color toner images (various color densities) can further expand the options for various color effects. An infinite number of color toner images with metallic effects can be produced using this invention.

It has also been found that the manufacture of the metallic dry toner particles can be carried out under certain melt extrusion conditions that enhance the uniform dispersion of the non-conductive metal oxide particles in the polymeric binder phase. When the extrusion conditions are controlled to minimize shear ("low shear conditions"), breakage of the non-conductive metal oxide particles is also minimized and the resulting metallic effect of these particles is enhanced in the resulting printed toner images. As noted below, in particular, the extrudate is formed with a drawdown before cooling and pulverizing that orients the plate-like non-conductive metal oxide particles generally in the same direction in which the extrudate is drawn.

The resulting toner images achieved using the method of this invention can be provided on various receiver materials as described below and the possible metallic effects are innumerable depending upon the non-conductive metal oxide particles, their concentrations, whether they are used alone or in combination with color toner images, and other factors that would be readily apparent to a skilled worker reading this disclosure.

BRIEF DESCRIPTION OF THE DRAWING

FIG. 1 is schematic side elevational view, in cross section, of a typical electrophotographic reproduction apparatus (printer) suitable for use in the practice of the present invention.

DETAILED DESCRIPTION OF THE INVENTION

Definitions

As used herein to define various components of the metallic dry toner particles, polymers, non-conductive metal oxide particles, colorants, and other components, unless otherwise indicated, the singular forms "a," "an," and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about." In this manner, slight variations above and below the stated ranges can be used to achieve substantially the same results as the values within the ranges. In addition, the disclosure of these ranges is intended as a continuous range including every value between the minimum and maximum values.

The terms "particle size," "size," and "sized" as used herein in reference to toner particles including the metallic dry toner particles used in this invention, is defined in terms of the mean volume weighted diameter ($D_{vol}$, in μm) as measured by conventional diameter measuring devices such as a Coulter Multisizer (Coulter, Inc.). The mean volume weighted diameter is the sum of the mass of each metallic dry toner particle multiplied by the diameter of a spherical particle of equal mass and density, divided by the total metallic dry toner particle mass.

"Equivalent circular diameter" (ECD) is used herein to define the size (for example, in μm) of non-conductive metal oxide particles or other types of particles described herein, and represents the diameter of a circle that has essentially the same area as a particle projected image where the particle is lying flat to the field of view. This allows irregularly shaped particles as well as spherical particles to be measured using the same parameter. Techniques for measuring ECD are known in the art.

The term "aspect ratio" in relation to the non-conductive metal oxide particles used in the practice of this invention (or for the metallic dry toner particles described herein) refers to the ratio of the average ECD of those particles (typically in μm) to the average thickness (typically in μm) of those particles. Such "average" values can be measured by evaluating the dimensions of particles under magnification and averaging the measurement of at least 100 individual particles.

The term "electrostatic printing process" as used herein refers to printing methods including but not limited to, electrophotography and direct, solid toner printing as described herein. As used in this invention, electrostatic printing means does not include the use of liquid toners to form images on receiver materials.

The term "color" as used herein refers to dry color toner particles containing one or more colorants (dyes or pigments) that provide a color or hue having an optical density of at least 0.2 at the maximum exposure so as to distinguish them from "colorless" dry toner particles that have a lower optical density.

The term "interference pigment" refers to a pigment that is capable of producing a color using an interference phenomenon, for example between the light reflected by a plurality of superposed layers with different refractive indices. An interference pigment can for example comprise multiple layers with different refractive indices.

The term "covering power" refers to the coloring strength (optical density) value of fixed toner particles on a specific receiver material. For example, covering power values can be determined by making patches of varying densities from non-fixed dry toner particles on a receiver material such as a clear film. The weight and area of each of these patches is measured, and the dry toner particles in each patch are fixed for example in an oven with controlled temperature that is hot enough to melt the dry toner particles sufficiently to form a continuous thin film in each patch on the receiver material. The transmission densities of the resulting patches of thin films are measured with a Status A blue filter on an X-rite densitometer (other conventional densitometers can be used). A plot of the patch transmission densities vs. initial patch dry toner weight is prepared, and the weight per unit area of toner thin film is calculated at a transmission density of 1.0. The reciprocal of this value, in units of $cm^2/g$ of fixed toner particles, is the "covering power." Another way of saying this is that the covering power is the area of the receiver material that is covered to a transmission density of 1.0 by 1 gram of fixed dry toner particles. As the covering power increases, the "yield" of the dry toner particles increases, meaning that less mass of dry toner particles is needed to create the same amount of density area coverage in a printed image on the receiver material. Thus, covering power is a measurement that is taken after the dry toner particles are fixed (or fused) to a given receiver material. A skilled worker would be able from this description to measure the covering power of any particular dry toner particle composition (containing polymer binder, colorants, and optional addenda), receiver material, and fixing conditions.

The term "non-conductive" in reference to the metallic dry toner particles refers to electrical properties and means that the metal oxide particles do not affect the charge and other electrical properties of the metallic dry toner particles at the disclosed concentrations of non-conductive metal oxide particles. In addition, the non-conductive metal oxide particles are non-magnetic, meaning that they do not exhibit magnetism to an appreciable extent in a magnetic field.

Dry Toner Particles

The present invention is carried out using metallic dry toner particles and compositions of multiple metallic dry toner particles as dry one-component and dry two-component developers that can be used for reproduction of a metallic hue or effect, such as a golden or silvery hue, in color toner images, by an electrostatic printing process, especially by an electrophotographic imaging process.

The metallic dry toner particles can be porous or nonporous. For example, if they are porous particles, up to 60% of the volume can be occupied or unoccupied pores within the polymeric binder phase (matrix). The non-conductive metal oxide particles can be within the pores or within the polymeric binder phase. In many embodiments, the metallic dry toner particles are not purposely designed to be porous although pores may be created unintentionally during manufacture. In such "nonporous" embodiments, the porosity of the metallic dry toner particles used in this invention is less than 5% based on the total particle volume within the external particle surface, and the non-conductive metal oxide particles are predominantly (at least 90 weight %) in the polymeric binder phase.

The metallic dry toner particles used in this invention are also non-magnetic in that magnetic materials are not purposely incorporated within the polymeric binder phase.

The metallic dry toner particles have an external particle surface and consist essentially of a polymeric binder phase and non-conductive metal oxide particles generally uniformly dispersed within the polymeric binder phase to provide, when fixed (or fused), the metallic effects described herein. As noted below, these metallic dry toner particles are used in combination with color toner particles that provide one or more non-metallic colors in a color toner image. In such embodiments, the metallic dry toner particles can enhance or provide various metallic effects for the various color toner images provided by the color toner particles.

Optional additives (described below) can be incorporated into the metallic dry toner particles used in this invention to provide various properties that are useful for electrostatic printing processes. However, since only the polymeric binder phase and the non-conductive metal oxide particles are essential for providing the metallic effects and for this purpose, these components are the only essential components of the metallic dry toner particles.

The polymeric binder phase is generally a continuous polymeric phase comprising one or more polymeric binders that are suitable for the various imaging methods described herein. Many useful binder polymers are known in the art as being suitable for forming dry toner particles as they will behave properly during thermal fixing of the toner particles to a suitable receiver material. Such polymeric binders generally are amorphous and each has a glass transition temperature ($T_g$) of at least 50° C. and up to and including 100° C. In addition, the metallic dry toner particles prepared from these polymeric binders have a caking temperature of at least 50° C. so that the metallic dry toner particles can be stored for relatively long periods of time at fairly high temperatures without having individual particles agglomerate and clump together.

Useful polymeric binders for providing the polymeric binder phase include but are not limited to, polycarbonates, resin-modified malic alkyd polymers, polyamides, phenol-formaldehyde polymers and various derivatives thereof, polyester condensates, modified alkyd polymers, aromatic polymers containing alternating methylene and aromatic units, and fusible crosslinked polymers.

Other useful polymeric binders are vinyl polymers, such as homopolymers and copolymers derived from two or more ethylenically unsaturated polymerizable monomers. For example, useful copolymers can be derived one or more of styrene or a styrene derivative, vinyl naphthalene, p-chlorostyrene, unsaturated mono-olefins such as ethylene, propylene, butylene, and isobutylene, vinyl halides such as vinyl chloride, vinyl bromide, and vinyl fluoride, vinyl acetate, vinyl propionate, vinyl benzoate, vinyl butyrate, vinyl esters such as esters of mono carboxylic acids including acrylates and methacrylates, acrylonitrile, methacrylonitrile, acrylamides, methacrylamide, vinyl ethers such as vinyl methyl ether, vinyl isobutyl ether, and vinyl ethyl ether, N-vinyl indole, N-vinyl pyrrolidone, and others that would be readily apparent to one skilled in the electrophotographic polymer art.

For example, homopolymers and copolymers derived from styrene or styrene derivatives can comprise at least 40 weight % and up to and including 100 weight % of recurring units derived from styrene or styrene derivatives (homologs) and from 0 and up to and including 40 weight % of recurring units derived from one or more lower alkyl acrylates or methacrylates (the term "lower alkyl" means alkyl groups having 1 to 6 carbon atoms). Other useful polymers include fusible styrene-acrylic copolymers that are partially crosslinked by incorporating recurring units derived from a divinyl ethylenically unsaturated polymerizable monomer such as divinylbenzene or a diacrylate or dimethacrylate. Polymeric binders of this type are described, for example, in U.S. Reissue Pat. No. 31,072 (Jadwin et al.) the disclosure of which is incorporated herein by reference. Mixtures of such polymeric binders can be used if desired in the metallic dry toner particles.

Some useful polymeric binders are derived from styrene or another vinyl aromatic ethylenically unsaturated polymerizable monomer and one or more alkyl acrylates, alkyl methacrylates, or dienes wherein the styrene recurring units comprise at least 60% by weight of the polymer. For example, copolymers that are derived from styrene and either butyl acrylate or butadiene are also useful as polymeric binders, or these copolymers can be part of blends of polymeric binders. For example, a blend of poly(styrene-co-butyl acrylate) and poly(styrene-co-butadiene) can be used wherein the weight ratio of the first polymeric binder to the second polymeric binder is from 10:1 to and including 1:10, or from 5:1 to and including 1:5.

Styrene-containing polymers are particularly useful and can be derived from one or more of styrene, α-methylstyrene, p-chlorostyrene, and vinyl toluene. Useful alkyl acrylates, alkyl methacrylates, and monocarboxylic acids that can be copolymerized with styrene or styrene derivatives include but are not limited to, acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, ethyl methacrylate, butyl methacrylate, and octyl methacrylate.

Condensation polymers are also useful as polymeric binders in the metallic dry toner particles. Useful condensation polymers include but are not limited to, polycarbonates, polyamides, polyesters, polywaxes, epoxy resins, polyurethanes, and polymeric esterification products of a polycarboxylic acid and a diol comprising a bisphenol. Particularly useful condensation polymeric binders include polyesters and copolyesters that are derived from one or more aromatic dicarboxylic acids and one or more aliphatic diols, including polyesters derived from isophthalic or terephthalic acid and diols such as ethylene glycol, cyclohexane dimethanol, and bisphenols (such as Bisphenol A). Other useful polyester binders can be obtained by the co-polycondensation polymerization of a carboxylic acid component comprising a carboxylic acid having two or more valencies, an acid anhydride thereof or a lower alkyl ester thereof (for example, fumaric acid, maleic acid, maleic anhydride, phthalic acid, terephthalic acid, trimellitic acid, or pyromellitic acid), using as a diol component a bisphenol derivative or a substituted compound thereof. Other useful polyesters are copolyesters prepared from terephthalic acid (including substituted terephthalic acid), a bis[(hydroxyalkoxy)phenyl]alkane having 1 to 4 carbon atoms in the alkoxy radical and from 1 to 10 carbon atoms in the alkane moiety (that can also be a halogen-substituted alkane), and an alkylene glycol having from 1 to 4 carbon atoms in the alkylene moiety. Specific examples of such condensation copolyesters and how they are made are provided for example in U.S. Pat. Nos. 5,120,631 (Kanbayashi et al.), 4,430,408 (Sitaramiah), and 5,714,295 (Wilson et al.), the disclosures of which are incorporated herein by reference for describing such polymeric binders. A useful polyester is a propoxylated bisphenol-A fumarate.

Useful polycarbonates are described in U.S. Pat. No. 3,694,359 (Merrill et al.) the disclosure of which is incorporated by reference, which polycarbonates can contain alklidene diarylene moieties in recurring units.

Other specific polymeric binders useful in the metallic dry toner particles are described in [0031] of U.S. Patent Application Publication 2011/0262858 (noted above) the disclosure of which is incorporated herein by reference.

In some embodiments, the polymeric binder phase comprises a polyester or a vinyl polymer derived at least in part from styrene or a styrene derivative, both of which are described above.

In general, one or more polymeric binders are present in the metallic dry toner particles in an amount of at least 50 weight % and up to and including 80 weight %, or typically at least 60 weight % and up to and including 75 weight %, based on the total metallic dry toner particle weight.

The metallic dry toner particles used in this invention are not generally perfectly spherical so it is best to define them by the mean volume weighted diameter ($D_{vol}$) that can be determined as described above. Before fixing, the $D_{vol}$ is generally at least 15 μm and up to and including 40 μm and typically at least 20 μm and up to and including 30 μm.

The metallic dry toner particles used in this invention can have an aspect ratio of at least 1, but more likely the aspect ratio is at least 2 and typically it is at least 3 and up to and including 10.

Moreover, before fixing (or thermal fusing), the ratio of the metallic dry toner particle $D_{vol}$ (for example, in μm) to the average equivalent circular diameter (ECD, also in μm) of the non-conductive metal oxide particles in the metallic dry toner particles, which is defined above, is greater than 0.1 and up to and including 10, or typically greater than 0.1 and up to and including 5. This parameter helps orient the non-conductive metal oxide particles parallel to the receiver material during the toner image transfer and fixing steps. For enhanced metallic appearance it is desirable that the non-conductive metal oxide particles are as large as possible and lie parallel to the plane of the receiver element upon which a toner image is formed. It was discovered that this effect could be successfully achieved by making metallic dry toner particles that are flattened in shape. Thus, not only do such metallic dry toner particles lie flat on an image-bearing surface, but they are able also to contain larger platelets or flakes of the non-conductive metal oxide particles. The method used to quantify and describe this flattened metallic dry toner particle shape, is the ratio of its $D_{vol}$ to the ECD of the non-conductive metal oxide particles incorporated therein where $D_{vol}$ and ECD are defined above. Therefore, for the more flattened metallic dry toner particles, the $D_{vol}$ is less than the ECD of the non-conductive metal oxide particles, and the noted ratio is less than 1. Because of the size distribution of the non-conductive metal oxide particles used in the manufacturing process and some breakage caused during that process, some metallic dry toner particles can comprise multiple smaller non-conductive metal oxide particles.

The non-conductive metal oxide particles used in the practice of this invention are generally in the shape of flakes or platelets. These particles are substantially 2-dimensional particles having opposed main surfaces or faces separated by a relatively minor thickness dimension. Generally, the non-conductive metal oxide particles have an average equivalent circular diameter (ECD) of at least 2 μm and up to and including 50 μm, or typically of at least 5 μm and up to and including 40 μm, or at least 5 μm and up to and including 25 μm. By "average" to define ECD, it is meant that the ECD value is the averaged value of at least 100 randomly chosen particles. The non-conductive metal oxide particles can be further characterized in having an aspect ratio (the ratio of main face equivalent circular diameter to thickness) of at least 2 and typically of at least 5, and up to and including 40. A particularly useful aspect ratio range for the non-conductive metal oxide particles is at least 5 and up to and including 25.

The non-conductive metal oxide particles used in this invention can be composed of any commercially available non-conductive metal oxide particles and can be provided in powder or suspension form. Such non-conductive metal oxide particles are generally interference pigments as defined above. These non-conductive metal oxide particles have only two essential components. One essential component is a substrate or core substance that contains but is not limited to, mica, alumina, titania, and silica. Substrates containing silica, mica, or alumina particles are particularly useful and substrates containing mica are more particularly desirable especially for providing gold-tone effects in a toner image. Alumina-containing substrates can be used for providing pearlescent effects in a toner image. The substrate of each non-conductive metal oxide particle has an outer surface usually on opposing sides of the plate-like particles.

Mixtures of different non-conductive metal oxide particles can be used in the same metallic dry toner particles if desired. For example, mica particles could be used in mixture with alumina, silica or other mica particles. The mica particles can be either naturally occurring or prepared by some synthetic process.

Examples of useful metal oxide particles include mica flakes that are commercially available as Mearlin® or Lumina Brass pigments available from BASF Corporation (New Jersey), Reflex Pearl™ pigments available from Sun Chemicals (Ohio), or Iriodin® pigments from EMD Chemicals Inc. (New Jersey), aluminum oxide particles that are commercially available as Xirallic® pigments from EMD Chemicals Inc., and silica particles that are commercially available as Colorstream® pigments from EMD Chemicals Inc.

The non-conductive metal oxide particles can also comprise, at least partially on their outer surface, a coating of an oxide of iron, chromium, silicon, titanium, or aluminum, or mixtures thereof, having an average dry coating thickness of up to and including 2,000 nm, or an average dry coating thickness, at least on a portion of the non-conductive metal oxide particles, of at least 50 nm and up to and including 2,000 nm, or of at least 100 nm and up to and including 1,000 nm. Some commercial products of non-conductive metal oxide particles already have such oxide of iron, chromium, silicon, titanium, or aluminum coatings when supplied to the user. Alternatively, such coatings can be provided using known coating techniques and coating materials as described in U.S. Patent Application Publication 2011/0236698 (Filou et al.) and U.S. Pat. No. 7,326,507 (noted above) both of which are incorporated herein by reference.

It is also possible to use non-conductive metal oxide particles that comprise at least two successive dry coatings wherein each successive dry coating comprises a different metal oxide selected from the group consisting of an oxide of iron, chromium, silicon, titanium, and aluminum, and each successive dry coating has an average dry coating thickness of at least 50 nm and up to and including 1,000 nm, and the total average dry thickness of all metal oxide coatings is at least 100 nm and up to and including 2,000 nm. Each successive dry coating can be present on the same or different part of the outer surface of the non-conductive metal oxide particles. For example, the non-conductive metal oxide particles can be coated with a silicate using a sol-gel process. The nonconductive metal oxide particles can be dispersed in a mixture of ethanol, water, stearic acid as a lubricant, and a metal oxide precursor such as a silica, titania, or alumina precursor. The silica precursor can be a tetraethoxysilane. A catalyst can be included to convert the metal oxide precursor to the metal oxide at least partially on the outer surface of the non-conductive metal oxide particles.

In some of these embodiments, the successive dry coating directly on the non-conductive metal oxide particles comprises an oxide of titanium.

Mixtures of different non-conductive metal oxide particles can be used in the same metallic dry toner particles if desired. For example, non-conductive metal oxide particles having a mica-containing substrate can be used in mixture with other non-conductive metal oxide particles having alumina-containing, silica-containing, or titania-containing substrates. The mica-containing substrates can be formed from either naturally occurring or synthetically prepared mica.

The non-conductive metal oxide particles have as a second essential component, at least partially disposed on the outer surface of the substrate, one or more layers of an oxide of iron, chromium, silicon, titanium, or aluminum, or mixtures thereof. Each of these one or more layers has an average dry layer thickness of at least 30 nm and up to and including 700 nm, or of at least 60 nm and up to and including 300 nm. The total average dry thickness of all of these oxide layers on the substrate is at least 30 nm and up to and including 1400 nm, or at least 60 nm and up to and including 600 nm.

In some embodiments, the non-conductive metal oxide particles consist essentially of a noted substrate and two layers of different oxides of iron, chromium, silicon, titanium, or aluminum, each of the two layers having an average dry layer thickness of at least 60 nm and up to and including 300 nm, so that the total average dry thickness of both oxide layers is at least 60 nm and up to and including 600 nm.

Some commercial products of non-conductive metal oxide particles already have such oxide of iron, chromium, silicon, titanium, or aluminum coatings on the substrate. Alternatively, such oxide coatings can be provided using known coating techniques and coating materials as described in U.S. Patent Application Publication 2011/0236698 (Filou et al.) and U.S. Pat. No. 7,326,507 (noted above) the disclosures of both of which are incorporated herein by reference.

At least one of the layers of an oxide of iron, chromium, silicon, titanium, or aluminum forms the outermost surface of the non-conductive metal oxide particles.

In some useful embodiments, the non-conductive metal oxide particles consist essentially of a single layer of titanium dioxide (titania) disposed on a mica substrate.

In other embodiments, the non-conductive metal oxide particles consist essentially of a single layer of titanium dioxide (titania) disposed on a mica substrate, and a single layer of ferric oxide disposed on the titanium dioxide layer.

Examples of useful non-conductive metal oxide particles having mica-containing substrates are commercially available as Mearlin® or Lumina Brass pigments available from BASF Corporation (New Jersey), Reflex Pearl™ pigments available from Sun Chemicals (Ohio), or Iriodin® pigments from EMD Chemicals Inc. (New Jersey), particles having alumina-containing substrates are commercially available as Xirallic® pigments from EMD Chemicals Inc., and particles having silica-containing substrates are commercially available as Colorstream® pigments from EMD Chemicals Inc.

It is also possible to use non-conductive metal oxide particles that comprise at least two or more successive dry oxide coatings on the substrate wherein each successive dry oxide coating comprises a different metal oxide selected from the group consisting of an oxide of iron, chromium, silicon, titanium, and aluminum, and each successive dry coating has an average dry coating thickness of at least 30 nm and up to and including 700 nm, and the total average dry thickness of all metal oxide coatings is at least 60 nm and up to and including 2,000 nm. Each successive dry oxide coating can be present on the same or different part of the outer surface of the non-conductive metal oxide particle substrate. For example, a mica substrate can be coated with a silicate using a sol-gel process. Particles mica, for example, can be dispersed as a substrate in a mixture of ethanol, water, stearic acid as a lubricant and a metal oxide precursor such as a silica, titania, or alumina precursor. A silica precursor can be a tetraethoxysilane. A catalyst can be included to convert the metal oxide precursor to the metal oxide at least partially on the outer surface of the mica substrate.

The mixtures noted above can be heated to speed hydrolysis of the silica, titania, or alumina precursor and reaction to form a silicate, titanate, or aluminate, which deposits on the substrate particles. A filtration operation can be carried out to filter off undesirable by-products such as catalysts, metal compounds, and stearic acid.

In some of these embodiments, the successive dry oxide coatings on the mica substrate comprise successive coatings of titanium dioxide, ferric oxide, or both.

In some embodiments, the metallic dry toner particles have a silane disposed on the outer surface of the non-conductive metal oxide particles in an amount of up to 5 weight %, based on the total dry weight of the non-conductive metal oxide particles in the particular metallic dry toner particle. The presence of this silane is not essential but can be present during the manufacture of the metallic dry toner particles to help disperse polymeric binders during melt compounding. While more than 5 weight % can be included during the manufacturing process, it is intended that only this minor amount remains in the resulting metallic dry toner particles after manufacturing.

Thus, the metal oxide coatings can be at least partially coated with a silane. Such silane coatings assist in the uniform dispersion of the non-conductive metal oxide particles in the polymeric binder phase of the metallic dry toner particles, and the more uniform the dispersion, the more effective the metallic effect in the resulting printed toner images.

The metal oxides used in the non-conductive metal oxide particles are generally hydrophilic and incompatible with organic polymers. Alkoxysilanes are useful to treat the surface of the metal oxide surface to make them more compatible and dispersible in the polymeric binder phase of the metallic dry toner particles. Metal oxides with hydroxyl groups on their surfaces are generally very receptive to bonding with alkoxysilanes. The silane treatment can be applied directly or as a solution of silane in water or alcohol. The amount of silane on the metal oxide surface would be a function of the surface area of the metal oxide. Typically, a monolayer to several layers of the silane could provide optimal dispersion quality on the polymeric binder phase resin. The optimal level of silane treatment would be determined using routine experimentation. To improve compatibility with the polymeric binder phase, it would be desired that the nature of the organic group on the silane would be similar to the chemical structure of the resin(s) used. For example, an octyl or longer-chain alkyl group will help provide compatibility and dispersibility of the metal oxides in mineral in typical dry toner polymeric binder phase resins.

It is also possible to first prepare a metal oxide concentrate in the toner polymeric binder phase resin in which it is compatible. By doing so, the work required to disperse the non-conductive metal oxide particles in the polymeric binder phase resins can be reduced and thereby reduce breakage of the non-conductive metal oxide particles, which is essential to enhance the metallic luster.

The non-conductive metal oxide particles are generally present in the metallic dry toner particles of this invention in an amount of at least 15 weight % and up to and including 50 weight %, or typically of at least 20 weight % and up to and including 40 weight %, or more likely of at least 20 weight % and up to and including 30 weight %, based on total metallic dry toner particle weight.

Various optional additives that can be present in the metallic dry toner particles can be added in the dry blend of resin particles and non-conductive metal oxide particles described below. Such optional additives include but are not limited to, colorants (such as dyes and pigments other than the non-conductive metal oxide particles), charge control agents, waxes, fuser release aids, leveling agents, surfactants, stabilizers, or any combinations of these materials. These additives are generally present in amounts that are known to be useful in the electrophotographic art as they are known to be used in other toner particles, including color toner particles.

In some embodiments, a spacing agent, fuser release aid, flow additive particles, or combinations of these materials can be provided on the outer surface of the metallic dry toner particles, and such materials are provided in amounts that are known in the electrophotographic art. Generally, such materials are added to the metallic dry toner particles after they have been prepared using the dry blending, melt extrusion, and breaking process (described below).

Inorganic or organic colorants (pigments or dyes) can be present in the metallic dry toner particles to provide any suitable color, tone, or hue other than the metallic tone that is achieved with the non-conductive metal oxide particles, to render them more visible. Other metallic dry toner particles are free of additional colorants.

Colorants can be incorporated into the polymeric binders in known ways, for example by incorporating them in the dry blends described below. Useful colorants or pigments include but are not limited to, titanium dioxide, carbon black, Aniline Blue, Calcoil Blue, Chrome Yellow, Ultramarine Blue, DuPont Oil Red, Quinoline Yellow, Methylene Blue Chloride, Malachite Green Oxalate, Lamp Black, Rose Bengal, Colour Index Pigment Red 48:1, Colour Index Pigment Red 57:1, Colour Index Pigment Yellow 97, Colour Index Pigment Yellow 17, Colour Index Pigment Blue 15:1, Colour Index Pigment Blue 15:3, phthalocyanines such as copper phthalocyanine, mono-chlor copper phthalocyanine, hexadecachlor copper phthalocyanine, Phthalocyanine Blue or Colour Index Pigment Green 7, and quinacridones such as Colour Index Pigment Violet 19 or Colour Index Pigment Red 122, and pigments such as HELIOGEN Blue™, HOSTAPERM Pink™, NOVAPERM Yellow™, LITHOL Scarlet™, MICROLITH Brown™, SUDAN Blue™, FANAL Pink™, and PV FAST Blue™. Such pigments do not include the non-conductive metal oxide particles that are also present in the metallic dry toner particles. Mixtures of colorants can be used. Other suitable colorants or pigments are described in U.S. Reissue Pat. 31,072 (noted above) and U.S. Pat. Nos. 4,160,644 (Ryan), 4,416,965 (Sandhu et al.), and 4,414,152 (Santilli et al.), the disclosures of which are incorporated herein by reference.

One or more of such colorants can be present in the metallic dry toner particles in an amount of at least 1 weight % and up to and including 20 weight %, or typically at least 2 and up to and including 15 weight %, based on the total metallic dry toner particle weight, but a skilled worker in the art would know how to adjust the amount of colorant so that the desired metallic effect can be obtained with the non-conductive metal oxide particles that are mixed with the colorants in the metallic dry toner particles.

The colorants can also be encapsulated using elastomeric resins that are included within the metallic dry toner particles. Such a process is described in U.S. Pat. No. 5,298,356 (Tyagi et al.) the disclosure of which is incorporated herein by reference.

For example, the metallic dry toner particles used in this invention can comprise non-conductive metal oxide particles (such as mica or alumina particles) in combination with a yellow, cyan, magenta, or black colorant, or mixtures thereof. Such metallic dry toner particles can be used in various dry mono-component developers or dry two-component developers that are described in more detail below.

Suitable charge control agents and their use in toner particles are well known in the art as described for example in the *Handbook of Imaging Materials,* $2^{nd}$ Edition, Marcel Dekker, Inc., New York, ISBN:0-8247-8903-2, pp. 180ff and references noted therein. The term "charge control" refers to a propensity of the material to modify the triboelectric charging properties of the metallic dry toner particle. A wide variety of charge control agents can be used as described in U.S. Pat. No. 3,893,935 (Jadwin et al.), U.S. Pat. No. 4,079,014 (Burness et al.), U.S. Pat. No. 4,323,634 (Jadwin et al.), U.S. Pat. No. 4,394,430 (Jadwin et al.), U.S. Pat. No. 4,624,907 (Motohashi et al.), U.S. Pat. No. 4,814,250 (Kwarta et al.), U.S. Pat. No. 4,840,864 (Bugner et al.), U.S. Pat. No. 4,834,920 (Bugner et al.), and U.S. Pat. No. 4,780,553 (Suzuka et al.), the disclosures of which are incorporated herein by reference. The charge control agents can be transparent or translucent and free of pigments and dyes. Generally, these compounds are colorless or nearly colorless. Mixtures of charge control agents can be used. A desired charge control agent can be chosen depending upon whether a positive or negative charging metallic dry toner particle is needed.

Examples of useful charge control agents include but are not limited to, triphenylmethane compounds, ammonium salts, aluminum-azo complexes, chromium-azo complexes, chromium salicylate organo-complex salts, azo-iron complex salts, an azo-iron complex salt such as ferrate (1-), bis[4-[5-chloro-2-hydroxyphenyl)azo]-3-hydroxy-N-phenyl-2-naphthalene-carboxamidato(2-)], ammonium, sodium, or hydrogen (Organoiron available from Hodogaya Chemical Company Ltd.). Other useful charge control agents include but are not limited to, acidic organic charge control agents such as 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoroethylphenyl)-3H-pyrazol-3-one and the corresponding zinc salts derived therefrom. Other examples include charge control agents with one or more acidic functional groups, such as fumaric acid, malic acid, adipic acid, terephthalic acid, salicylic acid, fumaric acid monoethyl ester, copolymers derived from styrene and methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide. Another class of charge control agents include, but are not limited to, iron organo metal complexes such as organo iron complexes, for example T77 from Hodogaya. Still another useful charge control agent is a quaternary ammonium functional acrylic polymer.

Other useful charge control agents include alkyl pyridinium halides such as cetyl pyridinium halide, cetyl pyridinium tetrafluoroborates, quaternary ammonium sulfate, and sulfonate charge control agents as described in U.S. Pat. No. 4,338,390 (Lu Chin) the disclosure of which is incorporated herein by reference, stearyl phenethyl dimethyl ammonium tosylates, distearyl dimethyl ammonium methyl sulfate, and stearyl dimethyl hydrogen ammonium tosylate.

One or more charge control agents can be present in the non-porous dry toner particles in an amount to provide a consistent level of charge of at least −40 μCoulomb/g and to and including −65 μCoulomb/g for a toner particle having a $D_{vol}$ of 8 μm, when charged. Examples of suitable amounts include at least 0.1 weight % and up to and including 10 weight %, based on the total metallic dry toner particle weight.

Useful waxes (can also be known as lubricants) that can be present in the metallic dry toner particles include low molecular weight polyolefins (polyalkylenes) such as polyethylene, polypropylene, and polybutene, such as Polywax 500 and Polywax 1000 waxes from Peterolite, Clariant PE130 and Licowax PE190 waxes from Clariant Chemicals, and Viscol 550 and Viscol 660 waxes from Sanyo. Also useful are ester waxed that are available from Nippon Oil and Fat under the WE-series. Other useful waxes include silicone resins that can be softened by heating, fatty acid amides such as oleamide, erucamide, ricinoleamide, and stearamide, vegetable waxes such as carnauba wax, rice wax, candelilla wax, Japan wax, and jojoba wax, animal waxes such as bees wax, mineral and petroleum waxes such as montan wax, ozocerite, ceresine, paraffin wax, microcrystalline wax, and Fischer-Tropsch wax, and modified products thereof. Irrespective to the origin, waxes having a melting point in the range of at least 30° C. and up to and including 150° C. are useful. One or more waxes can be present in an amount of at least 0.1 weight % and up to and including 20 weight %, or at least 1 weight % and up to and including 10 weight %, based on the total metallic dry toner particle weight. These waxes, especially the polyolefins, can be used also as fuser release aids. In some embodiments, the fuser release aids are waxes having 70% crystallinity as measured by differential scanning calorimetry (DSC).

In general, a useful wax has a number average molecular weight ($M_n$) of at least 500 and up to and including 7,000. Polyalkylene waxes that are useful as fuser release aids can have a polydispersity of at least 2 and up to and including 10 or typically of at least 3 and up to and including 5. Polydispersity is a number representing the weight average molecular weight ($M_w$) of the polyalkylene wax divided by its number average molecular weight ($M_n$).

Useful flow additive particles that can be present inside or on the outer surface of the metallic dry toner particles include but are not limited to, a metal oxide such as hydrophobic fumed silica particles. Alternatively, the flow additive particles can be both incorporated into the metallic dry toner particles and on their outer surface. In general, such flow additive particles have an average equivalent spherical diameter (ESD) of at least 5 nm and are provided in the metallic dry toner particles in an amount of at least 0.01 weight % and up to and including 10 weight %, based on the total metallic dry toner particles weight.

Surface treatment agents can also be on the outer surface of the metallic dry toner particles in an amount sufficient to permit the metallic dry toner particles to be stripped from carrier particles in a dry two-component developer by electrostatic forces associated with the charged image or by mechanical forces. Surface fuser release aids can be present on the outer surface of the metallic dry toner particles in an amount of at least 0.05 weight % and up to and including 1 weight %, based on the total dry weight of metallic dry toner particles. These materials can be applied to the outer surfaces of the metallic dry toner particles using known methods for example by powder mixing techniques.

Spacing treatment agent particles ("spacer particles") can be attached to the outer surface by electrostatic forces or physical means, or both. Useful surface treatment agents include but are not limited to, silica such as those commercially available from Degussa as R972 and RY200 or from Wasker as H2000. Other suitable surface treatment agents include but are not limited to, titania, aluminum, zirconia, or other metal oxide particles, and polymeric beads all generally having an ECD of less than 1 μm. Mixture of these materials can be used if desired, for example a mixture of hydrophobic silica and hydrophobic titania particles.

Preparation of Dry Toner Particles

In a typical manufacturing method for preparing the metallic dry toner particles of this invention, a desired polymer binder (or mixture of polymeric binders) for use in the metallic dry toner particles is produced independently using polymerization processes known in the art.

The one or more polymeric binders are provided as polymeric resin particles and dry blended or mixed with suitable non-conductive metal oxide particles as described above to form a dry blend. The optional additives, such as charge control agents, waxes, fuser release aids, and colorants are also incorporated into the dry blend with the two essential components.

The amounts of the essential and optional components can be adjusted in the dry blend in a suitable manner that a skilled worker would readily understand to provide the desired amounts in the resulting metallic dry toner particles. The conditions and apparatus for mechanical dry blending are known in the art. For example, the method can comprise dry blending the resin particles with non-conductive metal oxide particles and a charge control agent, and optionally with a wax or colorant, or any combination of these optional components, to form a dry blend. The dry blend can be prepared by mechanically blending the components for a suitable time to obtain a uniform dry mix.

The dry blend is then melt processed in a suitable extrusion device such as a two-roll mill or hot-melt extruder. In particular, the dry melt is extruded under low shear conditions in an extrusion device to form an extruded composition. The "low shear conditions" are advantageous in order to minimize breakage of the non-conductive metal oxide particles and to orient these particles in the direction of the extrusion, and thus provide maximum metallic effect (for example luster) in the final toner image. The melt processing time can be from 1 minute to and including 60 minutes, and the time can be adjusted by a skilled worker to provide the desired melt processing temperature and uniformity in the resulting extruded composition.

For example, it is useful to melt extrude a dry blend of the noted components that has a viscosity of at least 90 pascals sec to and including 2300 pascals sec, or typically of at least 150 pascals sec to and including 1200 pascals sec. This control of melt viscosity also reduces shear conditions and thus reduces breakage of the non-conductive metal oxide particles.

Generally, the dry blend is melt extruded in the extrusion device at a temperature higher than the glass transition temperature of the one or more polymeric binders used to form the polymeric binder phase, and generally at a temperature of at least 90° C. and up to and including 240° C. or typically of at least 120° C. and up to and including 160° C. The temperature results, in part, from the frictional forces of the melt extrusion process. Control of the melt extrusion temperature is yet another way to reduce shear so that breakage of the non-conductive metal oxide particles is minimized.

In many embodiments, the non-conductive metal oxide particles can be oriented in the same direction in the extruded composition (melt extrudate) as it exits the extrusion device by extending the extruded composition so that it stays intact before breaking it into metallic dry toner particles. This operation can improve the resulting metallic effect of the fixed metallic dry toner particles because when the non-conductive metal oxide particles are oriented in the same direction, reduced breakage of these particles results as the extruded composition is cooled and broken into individual metallic dry toner particles.

The exit die opening in the extrusion device can be designed to promote convergence or orientation of the non-conductive metal oxide particles in one direction as the extrusion composition exits the extrusion device. Further, by extending the extrusion composition in the direction of the extrusion device exit, the non-conductive metal oxide particles can be further aligned mostly in the one direction. This desired orientation of the non-conductive metal oxide particles is frozen as the extrusion composition is cooled prior to pulverization or grinding. This results in the metallic dry toner particles having a flattened shape, which as noted above, can be advantageous. Moreover, the reinforcement within the metallic dry toner particles caused by the non-conductive metal oxide particles in the one stretched direction enables the production of larger flattened metallic dry toner particles during pulverizing or grinding.

Thus, the melt extrudate (extruded composition) can be drawn out in the extrusion direction after exiting an exit die to orient the non-conductive metal oxide particles in the same direction (the direction of stretching). A proper melt viscosity and drawdown ratio (ratio of the diameter of the stretched extruded composition to its original diameter) would be at least 1.5 and up to and including 40 with a drawdown ratio of less than 20 being desirable. As anyone skilled in this art of melt extrusion would appreciate, the exit die cross-section and the final extrusion composition cross-section can be judiciously selected to provide the optimal orientation of the non-conductive metal oxide particles in the extrusion composition. Such parameters can thus be established depending on the processing equipment using the information provided herein and what a skilled worker in the art would already know about such melt extrusion processes.

The resulting extruded composition (sometimes also known as a "melt product" or a "melt slab") is generally cooled, for example, to room temperature, and then broken up (for example pulverized) into metallic dry toner particles having the desired $D_{vol}$ of at least 15 μm and up to and including 40 μm and typically of at least 20 μm and up to and including 30 μm. It is generally best to first grind the extruded composition prior to a specific pulverizing operation. Grinding can be carried out using any suitable procedure. For example, the extruded composition can be crushed and then ground using for example a fluid energy or jet mill as described for example in U.S. Pat. No. 4,089,472 (Seigel et al.). The particles can then be further reduced in size by using high shear pulverizing devices such as a fluid energy mill, and then appropriately classified to desired sizes.

Each of the metallic dry toner particles prepared in this manner consists essentially of a polymeric binder phase formed from the metallic resin particles, and the non-conductive metal oxide particles (described above) that are dispersed within the polymeric binder phase, and any optional additives are also distributed within (usually uniformly) the polymeric binder phase.

The resulting metallic dry toner particles can then be surface treated with suitable hydrophobic flow additive particles having an equivalent circular diameter (ECD) of at least 5 nm and up to a desired size, to affix such hydrophobic flow additive particles on the outer surface of the metallic dry toner particles. These hydrophobic flow additive particles can be composed of metal oxide particles such as hydrophobic fumed oxides such as silica, alumina, or titania in an amount of at least 0.01 weight % and up to and including 10 weight % or typically at least 0.1 weight % and up to and including 5 weight %, based on the total metallic dry toner particle weight.

In particular, a hydrophobic fumed silica such as R972 or RY200 (from Nippon Aerosil) can be used for this purpose, and the amount of the fumed silica particles can be as noted above, or more typically at least 0.1 weight % and up to and including 3 weight %, based on the total metallic dry toner particle weight.

The hydrophobic flow additive particles can be added to the outer surface of the metallic dry toner particles by mixing both types of particles in a 10 liter Henschel mixer for at least 2 minutes and up to 2000 rpm.

The resulting treated metallic dry toner particles can be further classified (sieved) through a 230 mesh vibratory sieve to remove non-attached silica particles, silica agglomerates, and any non-conductive metal oxide particles that are outside the metallic dry toner particles. The temperature during the surface treatment can be controlled to provide the desired attachment and blending.

Dry color toner particles useful to provide color toner images can be prepared in various ways, including the melt extrusion processes described above for the metallic dry toner particles. Alternatively, the dry color toners can be prepared as "chemically prepared toners", "polymerized toners", or "in-situ toners". They can be prepared using controlled growing. Various chemical processes include suspension polymers, emulsion aggregation, micro-encapsulation, dispersion, and chemical milling. Details of such processes are described for example in the literature cited in [0010] of U.S. Patent Application Publication 2010/0164218 (Schulze-Hagenest et al.) the disclosure of which is incorporated herein by reference. Dry color toners can also be prepared using limited coalescence process as described in U.S. Pat. No. 5,298,356 (Tyagi et al.) the disclosure of which is incorporated herein by reference, or a water-in-oil-in-water double emulsion process as described in U.S. Patent Application Publication 2011/0262858 (Nair et al.) the disclosure of which is incorporated herein by reference, especially if porosity is desired in the dry color toners, but without the encapsulated metal flakes. Another method for preparing dry color toner particles is by a spray/freeze drying technique as described in U.S. Patent Application Publication 2011/0262654 (Yates et al.) the disclosure of which is incorporated herein by reference.

The various color toners can be provided using a suitable polymeric binder phase comprising one or more polymeric binders (as described above) and one or more cyan, yellow, magenta, or black colorants. For example, such colorants can be in principle any of the colorants described in the Colour Index, Vols. I and II, 2$^{nd}$ Edition (1987) or in the Pantone® Color Formula Guide, 1$^{st}$ Edition, 2000-2001. The choice of particular colorants for the cyan, yellow, magenta, and black (CYMK) color toners is well described in the art, for example in the proceedings of *IS&T NIP* 20: International Conference on Digital Printing Technologies, IS&T: The Society for Imaging Science and Technology, 7003 Kilworth Lane, Springfield, Va. 22151 USA ISBM: 0-89208-253-4, p. 135. Carbon black is generally useful as the black toner colorant while other colorants for the CYM color toners include but are not limited to, red, blue, and green pigments, respectively. Specific colorants can include copper phthalocyanine and Pigment Blue that can be obtained as Lupreton Blue™ SE1163. Other useful colorants are described above as colorant additives for the metallic dry toner particles of this invention.

The amount of one or more colorants in the dry color toners can vary over a wide range and skilled worker in the art would know how to pick the appropriate amount for a given colorant or mixture of colorants. In general, the total colorants in each color toner can be at least 1 weight % and up to and including 40 weight %, or typically at least 3 weight % and up to and including 25 weight %, based on the total dry color toner weight. The colorant in each dry color toner can also have the function of providing charge control, and a charge control agent (as described above) can also provide coloration. All of the additives described above for the metallic dry toner particles of this invention can likewise be used in the color toners, except that they do not contain the non-conductive metal oxide particles as described above.

Developers

The metallic dry toner particles used in this invention can be used as a dry mono-component developer, or combined with carrier particles to form dry two-component developers. In all of these embodiments, a plurality (usually thousands or millions) of individual metallic dry toner particles are used together. The dry mono-component developers and dry two-component developers containing metallic dry toner particles comprising mica-containing non-conductive metal oxide particles are particularly useful and such non-conductive metal oxide particles can have an aspect ratio of at least 5.

Such dry mono-component or dry two-component developers generally comprise a charge control agent, wax, lubricant, fuser release aid, or any combination of these materials within the metallic dry toner particles, or they can also include flow additive particles on the outer surface of the metallic dry toner particles. Such components are described above.

Useful dry one-component developers generally include the metallic dry toner particles as the essential component. Dry two-component developers generally comprise carrier particles (also known as carrier vehicles) that are known in the electrophotographic art and can be selected from a variety of materials. Carrier particles can be uncoated carrier core particles (such as magnetic particles) and core magnetic particles that are overcoated with a thin layer of a film-forming polymer such as a silicone resin type polymer, poly(vinylidene fluoride), poly(methyl methacrylate), or mixtures of poly(vinylidene fluoride) and poly(methyl methacrylate).

The amount of metallic dry toner particles in a two-component developer can be at least 2 weight % and up to and including 20 weight % based on the total dry weight of the two-component dry developer.

Image Formation Using Metallic Dry Toner Particles

The metallic dry toner particles used in this invention can be applied to a suitable receiver material (or substrate) of any type using various methods such as a digital printing process such as an electrostatic printing process, or electrophotographic printing process as described in L. B. Schein, *Electrophotography and Development Physics,* 2$^{nd}$ Edition, Laplacian Press, Morgan Hill, Calif., 1996 (ISBN 1-885540-02-7), or by an electrostatic coating process as described for example in U.S. Pat. No. 6,342,273 (Handels et al.) the disclosure of which is incorporated herein by reference. In some embodiments, developed latent images can be directly transferred to the "final" receiver element and then fixed to that receiver element.

Such receiver materials include, but are not limited to, coated or uncoated papers (cellulosic or polymeric papers), transparent polymeric films, ceramics, paperboard, cardboard, metals, fibrous webs or ribbons, and other substrate materials that would be readily apparent to one skilled in the art. In particular, the receiver materials (also known as the final receiver material or final receiver material) can be sheets of paper or polymeric films that are fed from a supply of receiver materials.

For example, the metallic dry toner particles comprising silica-, mica-, or alumina-containing non-conductive metal oxide particles in a polymeric binder phase, can be applied to a receiver material by a digital printing process such as an electrostatic printing process that includes but is not limited to, an electrophotographic printing process, or by a coating process such as an electrostatic coating process including an electrostatic brush coating as described in U.S. Pat. No. 6,342,273 (noted above).

In one electrophotographic method, a latent image (that is an electrostatic latent image) can be formed on a primary imaging member such as a charged photoconductor belt or roller using a suitable light source such as a laser or light emitting diode. This latent image is then developed on the primary imaging member by bringing the latent image into close proximity with a dry one-component or dry two-component developer comprising the metallic dry toner particles described herein to form a visible developed toner image on the primary imaging member.

In the embodiments of multi-color printing, multiple photoconductors can be used, each developing a separate color toner image and another for developing the toner image that provides a metallic effect. Alternatively, a single photoconductor can be used with multiple developing stations where after each color is developed, it is transferred to the receiver material or to an intermediate transfer member (belt or rubber) and then to the receiver material after all of the toner images have been accumulated on the intermediate transfer member.

In some embodiments, it is desirable to develop and fix the latent image with sufficient metallic dry toner particles to form a developed and fixed toner image having a metallic dry toner particle lay down (in mg/cm$^2$) that is defined by the following equation:

$$\text{Lay down} \leq [0.06 \times D_{vol}]$$

wherein $D_{vol}$ for the metallic dry toner particles is as defined above. This lay down provides the maximum metallic appearance or effect (luster) in the resulting toner image when the non-conductive metal oxide particles are fixed in an orientation that is parallel to the receiver material.

When the metallic dry toner particles are used according to this invention to provide a metallic effect in combination with one or more color toner images, the lay down for the metallic dry toner particles of this invention can be less than, the same as, or more than the lay down for the color toners used to provide a given enhanced color toner image. This enables the user to provide an infinite variation of metallic effects using various amounts of the respective toner particles. For example, the lay down for the metallic dry toner particles of this invention can be 1/100 of the lay down of the color toner particles in the enhanced color image, or the lay down of the metallic dry toner particles of this invention can be 100 times the lay down of the color toner particles in the enhanced color image, or greater or less ratio, or any ratio in between.

While the visible developed toner image can be transferred to a final receiver (receiver material) using a thermal or thermal assist process as is known in the art, it is generally transferred using an electrostatic process including an electrophotographic process such as that described in L. B. Schein, *Electrophotography and Development Physics,* 2$^{nd}$ Edition, Laplacian Press, Morgan Hill, Calif., 1996. The electrostatic transfer can be accomplished using a corona charger or an electrically biased transfer roller to press the receiver material into contact with the primary imaging member while applying an electrostatic field. In an alternative embodiment, the visible developed toner image can be first transferred from the primary imaging member to an intermediate transfer member (belt or roller) that serves as a receiver material, but not as the final receiver material, and then transferred from the intermediate transfer member to the final receiver material.

Electrophotographic color printing generally includes subtractive color mixing wherein different printing stations in a given apparatus are equipped with cyan, yellow, magenta, and black toner particles, to be applied in any desired sequence. Thus, a plurality of toner images of different colors can be applied to the same primary imaging member (such as dielectric member), intermediate transfer member, and final receiver material, including one or more color toner images in combination with the toner image comprising the metallic dry toner particles described herein that provide a metallic effect. Such different toner images are generally applied or transferred to the final receiver material in a desired sequence or succession using successive toner application or printing stations as described below.

The various transferred toner images are then fixed (thermally fused) on the receiver material in order to permanently affix them to the receiver material. This fixing can be done using various means such as heating alone (non-contact fixing) using an oven, hot air, radiant, or microwave fusing, or by passing the toner image(s) through a pair of heated rollers (contact fixing) to thereby apply both heat and pressure to the toner image(s) containing toner particles. Generally, one of the rollers is heated to a higher temperature and can have an optional release fluid to its surface. This roller can be referred to as the fuser roller, and the other roller is generally heated to a lower temperature and usually serves the function of applying pressure to the nip formed between the rollers as the toner image(s) is passed through. This second roller can be referred to as a pressure roller. Whatever fixing means is used, the fixing temperature is generally higher than the glass transition temperature of the metallic dry toner particles, which $T_g$ can be at least 45° C. and up to and including 90° C. or at least 50° C. and up to and including 70° C. Thus, fixing is generally at a temperature of at least 95° C. and up to and including 220° C. or more generally at a temperature of at least 135° C. and up to and including 210° C.

As the visible developed toner image(s) on the receiver material is passed through the nip formed between the two rollers, the dry toner particles in the visible developed toner image(s) are softened as their temperature is increased upon contact with the fuser roller. The melted toner particles generally remain affixed on surface of the receiver material.

In some embodiments of this invention, a method for forming an image comprises:

forming a toner image that provides a metallic effect on a receiver material, and fixing the toner image that provides a metallic effect on the receiver material, wherein the toner image that provides a metallic effect is formed using metallic dry toner particles as described above.

In other embodiments, the method can also comprise:

forming the toner image that provides a metallic effect on the receiver material, which toner image is provided using the metallic dry toner particles described herein, forming at least one color toner image over the toner image that provides a metallic effect, and fixing both the toner image that provides a metallic effect and the at least one color toner image to the receiver material.

Alternatively, the method can comprise:

forming at least one color toner image on the receiver material, forming the toner image that provides a metallic effect over the color toner image, and fixing both the toner image that provides a metallic effect and the at least one color toner image to the receiver material.

Still again, the method can comprise:

forming a cyan, yellow, magenta, or black toner image on a receiver material, in any sequence then forming the toner image that provides a metallic effect, using the metallic dry toner particles as described herein, over the cyan, yellow, magenta, or black toner image, and fixing both the cyan, yellow, magenta, or black image and the toner image that provides a metallic effect to the receiver material.

In yet other embodiments, the method comprises:

forming the toner image that provides a metallic effect on the receiver material, then forming in any sequence, cyan, yellow, magenta, and black toner images over the toner image that provides a metallic effect, and fixing all of the cyan, yellow, magenta, and black toner images, and the toner image that provides a metallic effect to the receiver material.

It is advantageous that the present invention can be used in a printing apparatus with multiple printing stations, for example where the metallic dry toner particles that provide a metallic effect can be applied to a receiver material at a first printing station, and one or more color toners can be applied in subsequent printing stations Certain embodiments of the invention where multiple color toner images are printed along with the metallic images from the dry metallic toner particles of this invention can be achieved using a printing machine that incorporates at least five printing stations or printing units. For example, the printing method can comprise forming black (K), yellow (Y), magenta (M), and cyan (C) toner images, and the toner image that provides a metallic effect (Mt), on the receiver material using at least five sequential toner stations in a color electrophotographic printing machine. These applications of C, Y, M, K, and Mt toner particles and toner images can be carried out in various orders or sequences, but the most common orders of application include KCMY, and the application of Mt either before or after KCMY applications.

For example, the KCMY dry toner particles can be printed in successive printing stations in the same or different apparatus, followed by printing the metallic dry toner particles that provide a metallic effect. Thus, the metallic dry toner particles that provide a metallic effect are applied over the KCMY toner particles (or toner images).

For example, such a method can comprise:

forming, in this sequence, black, cyan, yellow, and magenta toner images on a receiver material, then forming the toner image that provides a metallic effect, using the metallic dry toner particles of this invention, over or around the black, cyan, yellow, and magenta cyan toner images, and fixing all of the black, cyan, yellow, and magenta toner images, and the toner image that provides a metallic effect to the receiver material.

This arrangement and useful printing apparatus are illustrated for example in FIG. 1 of U.S. Patent Application Publication 2010/0164218 (noted above) that is incorporated herein by reference for these apparatus details. For example in this FIG. 1 illustration, a printing machine 1 comprises a printing station or unit 2 that can be used to apply the metallic dry toner particles described herein to provide the desired metallic effect. Additional printing stations or units 3 through 6 can be used for applying individual dry color toners, such as individual KCMY color toners (and toner images). Also in FIG. 1 of this publication, in the printing mechanism 7 in which the KCMY toner images are applied, a suitable receiver material (or substrate) 8, such as polymeric films, paper sheets, cardboard or other packaging materials, is conveyed along a travel path in the direction of arrow 11. The receiver material 8 sequentially passes through the printing mechanism 7, printing unit 2, and fixing mechanism 13 for appropriate fixing (or fusing) of all toner images applied in the printing machine 1 to receiver material 8.

A similar printing machine is illustrated in FIG. 1 of U.S. Pat. No. 7,139,521 (Ng et al.) the disclosure of which is incorporated herein by reference, in which the fifth printing station is used for applying the metallic dry toner particles described herein instead of the transparent toner particles described in the patent.

Still another printing machine is illustrated in FIG. 1 of the present application. FIG. 1 is a side elevational view schematically showing portions of a typical electrophotographic print engine or printer apparatus suitable for printing of one or more toner images. An electrophotographic printer apparatus 100 has a number of sequentially arranged electrophotographic image forming printing modules M1, M2, M3, M4, and M5. Each of the printing modules generates a single dry color toner image for transfer to a receiver material successively moved through the modules. Each receiver material, during a single pass through the five modules, can have transferred in registration thereto up to five single toner images. A toner image formed on a receiver material can comprise combinations of subsets of the CYMK colors and the metallic dry toner particles to form a metal effect, on the receiver material at various locations on the receiver material. In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 can form the image that provides the metallic effect. Alternatively, M1 can provide the image that provides the metallic effect, and M2 through M5 can provide composite KCMY, KMYC, or KYMC toner images, in a desired sequence.

Receiver materials 5 as shown in FIG. 1 are delivered from a paper supply unit (not shown) and transported through the printing modules M1-M5. The receiver materials are adhered [for example electrostatically using coupled corona tack-down chargers (not shown)] to an endless transport web 101 entrained and driven about rollers 102, 103.

Each of the printing modules M1-M5 includes a photoconductive imaging roller 111, an intermediate transfer roller 112, and a transfer backup roller 113, as is known in the art. For example, at printing module M1, a particular toner separation image can be created on the photoconductive imaging roller 111, transferred to intermediate transfer roller 112, and transferred again to a receiver member 5 moving through a transfer station, which transfer station includes intermediate transfer roller 112 forming a pressure nip with a corresponding transfer backup roller 113.

A receiver material can sequentially pass through the printing modules M1 through M5. In each of the printing modules a toner separation image can be formed on the receiver material 5 to provide a desired color toner image as is known in the art.

Printing apparatus 100 has a fuser of any well known construction, such as the shown fuser assembly 60 using fuser rollers 62 and 64. Even though a fuser 60 using fuser rollers 62 and 64 is shown, it is noted that different non-contact fusers using primarily heat for the fusing step can be beneficial as they can reduce compaction of toner layers formed on the receiver material 5, thereby enhancing tactile feel.

A logic and control unit (LCU) 230 can include one or more processors and in response to signals from various sensors (CONT) associated with the electrophotographic printer apparatus 100 provides timing and control signals to the respective components to provide control of the various components and process control parameters of the apparatus as known in the art.

Although not shown, the printer apparatus 100 can have a duplex path to allow feeding a receiver material having a fused toner image thereon back to printing modules M1 through M5. When such a duplex path is provided, two sided printing on the receiver material or multiple printing on the same side is possible.

Operation of the printing apparatus 100 will be described. Image data for writing by the printer apparatus 100 are received and can be processed by a raster image processor (RIP), which can include a color separation screen generator or generators. The image data include information to be formed on a receiver material, which information is also processed by the raster image processor. The output of the RIP can be stored in frame or line buffers for transmission of the color separation print data to each of the respective printing modules M1 through M5 for printing color separations for K, Y, M, C, and Mt, in the desired order. The RIP or color separation screen generator can be a part of the printer apparatus or remote therefrom. Image data processed by the RIP can at least partially include data from a color document scanner, a digital camera, a computer, a memory or network. The image data typically include image data representing a continuous image that needs to be reprocessed into halftone image data in order to be adequately represented by the printer.

While these embodiments refer to a printing machine comprising five sets of single toner image producing or printing stations or modules arranged in tandem (sequence), a printing machine can be used that includes more or less than five printing stations to provide a composite color toner image on the receiver material with more or less than five different toner images. Useful printing machines also include other electrophotographic writers or printer apparatus.

A printing machine like that described above can be designed so that the metallic dry toner particles that provide a metallic effect are applied to the receiver material before the KCMY toner particles are applied in a desired sequence. In such embodiments, the metallic dry toner particles that provide a metallic effect are under the KCMY toner particles (color toner images).

For example, such a method can comprise:

forming the toner image that provides a metallic effect on the receiver material with the metallic dry toner particles described herein, then forming a cyan, yellow, magenta, or black toner image over the toner image that provides a metallic effect, with the dry color toner particles, and fixing both the toner image that provides a metallic effect and the cyan, yellow, magenta, or black toner image to the receiver material.

Alternatively, a printing machine can be designed so that KYMC dry toner particles are applied to the receiver material in sequence followed by application of the metallic dry toner particles that provide a metallic effect. In such embodiments, the method applies the metallic dry toner particles to the receiver material between the sequential application of KYMC dry toner particles and the later application of the black dry toner particles. This could be identified as a KYM-Mt-C application of toner images.

For example, such a method can comprise:

forming in this sequence, black, yellow, and magenta toner images on the receiver material, then forming the toner image that provides a metallic effect over the black, yellow, and magenta toner images, then forming a cyan toner image over the toner image that provides a metallic effect and the black, yellow, and magenta toner images, and fixing all of the black, yellow, and magenta toner images, the toner image that provides a metallic effect, and the cyan toner image, to the receiver material.

The present invention provides at least the following embodiments and combinations thereof, but other combinations of features are considered to be within the present invention as a skilled artisan would appreciate from the teaching of this disclosure:

1. A method for providing a color image with a metallic effect, the method comprising:

forming one or more latent images, developing the one or more latent images with both metallic dry toner particles and color toner particles to form a developed color toner image with a metallic effect, transferring the developed color toner image containing the metallic dry toner particles to a receiver material to form a transferred developed color toner image with a metallic effect, and fixing the transferred developed color toner image with a metallic effect to the receiver material, wherein each metallic dry toner particle consists essentially of a polymeric binder phase and non-conductive metal oxide particles dispersed within the polymeric binder phase, wherein, before fixing:

(a) each metallic dry toner particle has a mean volume weighted diameter ($D_{vol}$) of at least 15 μm and up to and including 40 μm, (b) at least 50 weight % of the total non-conductive metal oxide particles within the metallic dry toner particles have an aspect ratio of at least 5 and an ECD of at least 2 μm and up to and including 50 μm, (c) the non-conductive metal oxide particles are present in an amount of at least 15 weight % and up to and including 50 weight %, based on total metallic dry toner particle weight, (d) the ratio of the metallic dry toner particle $D_{vol}$ to the average equivalent circular diameter (ECD) of the non-conductive metal oxide particles in the metallic dry toner particles, before fixing, is greater than 0.1 and up to and including 10, (e) the non-conductive metal oxide particles consist essentially of (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 30 nm and up to and including 700 nm so that the total average dry thickness of all oxide layers is at least 30 nm and up to and including 1400 nm, and (f) at least one of the layers of an oxide of iron, chromium, silicon, titanium, or aluminum, forms the outermost layer of the non-conductive metal oxide particles.

2. The method of embodiment 1, wherein the color toner particles comprise a polymeric binder phase and a cyan, yellow, magenta, or black colorant dispersed within the polymeric binder phase.

3. The method of embodiment 1 or 2, comprising:

forming the toner image that provides a metallic effect on the receiver material with the metallic dry toner particles, then forming a cyan, yellow, magenta, or black toner image over the toner image that provides a metallic effect, with the color toner particles, and fixing both the toner image that provides a metallic effect and the cyan, yellow, magenta, or black toner image to the receiver material.

4. The method of embodiment 1 or 2, comprising:

forming a cyan, yellow, magenta, or black toner image on a receiver material, then forming the toner image that provides a metallic effect over the cyan, yellow, magenta, or black toner image, and fixing both the cyan, yellow, magenta, or black image and the toner image that provides a metallic effect to the receiver material.

5. The method of any of embodiments 1, 2 or 4, comprising:

forming, in any sequence, black, yellow, magenta, and cyan toner images on a receiver material, then forming the toner image that provides a metallic effect over the black, yellow, magenta, and cyan toner images, and fixing all of the black, yellow, magenta, and cyan toner images, and the toner image that provides a metallic effect to the receiver material.

6. The method of any of embodiments 1 to 3, comprising:

forming, the toner image that provides a metallic effect on the receiver material, then forming in this sequence, cyan, yellow, magenta, and black toner images over the toner image that provides a metallic effect, and fixing all of the cyan, yellow, magenta, and black toner images, and the toner image that provides a metallic effect to the receiver material.

7. The method of embodiment 1 or 2, comprising:

forming in this sequence, black, yellow, and magenta toner images on the receiver material, then forming the toner image that provides a metallic effect over the black, yellow, and magenta toner images, then forming a cyan toner image over the toner image that provides a metallic effect and the black, yellow, and magenta toner images, and fixing all of the black, yellow, and magenta toner images, the toner image that provides a metallic effect, and the cyan toner image, to the receiver material.

8. The method of any of embodiments 1 to 7, wherein the lay down of the metallic dry toner particles in the toner image that provides a metallic effect is defined by the equation, in $mg/cm^2$:

$$\text{Lay down} \leq [0.06 \times D_{vol}].$$

9. The method of any of embodiments 1 to 8, wherein the non-conductive metal oxide particles consist essentially of: (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 60 nm and up to and including 300 nm so that the total average dry thickness of all oxide layers is at least 60 nm and up to and including 600 nm.

10. The method of any of embodiments 1 to 9, wherein the non-conductive metal oxide particles consist essentially of: (i) a silica, alumina, or mica substrate having an outer surface, and (ii) disposed on at least part of the substrate outer surface, two layers of different oxides of iron, chromium, silicon, titanium, or aluminum, each of the two layers having an average dry layer thickness of at least 60 nm and up to and including 300 nm so that the total average dry thickness of both oxide layers is at least 60 nm and up to and including 600 nm.

11. The method of any of embodiments 1 to 10, wherein at least one dry layer disposed on the silica, alumina, or mica substrate comprises titanium dioxide, ferric oxide, or chromium oxide, or mixtures thereof.

12. The method of any of embodiments 1 to 11, wherein the non-conductive metal oxide particles consist essentially of a mica substrate having an outer surface, and a titanium dioxide layer, ferric oxide layer, or both a titanium dioxide layer and a ferric oxide layer disposed on at least part of the substrate outer surface.

13. The method of any of embodiments 1 to 12, wherein a silane is disposed on the outer surface of the non-conductive metal oxide particles in an amount of up to 5% based on the total weight of the non-conductive metal oxide particles.

14. The method of any of embodiments 1 to 13, wherein the metallic dry toner particles further comprise a colorant.

15. The method of any of embodiments 1 to 14, wherein the ratio of the metallic dry toner particle $D_{vol}$ to the average equivalent circular diameter (ECD) of the non-conductive metal oxide particles in the metallic dry toner particles, before fixing, is greater than 0.1 and up to and including 5.

16. The method of any of embodiments 1 to 15, wherein the metallic dry toner particles have an aspect ratio of at least 2.

17. The method of any of embodiments 1 to 16, wherein the metallic dry toner particles further comprise, on their outer surface, a fuser release aid, flow additive particles, or both of these materials.

18. The method of any of embodiments 1 to 17, wherein the receiver material is a sheet of paper or a polymeric film.

19. The method of any of embodiments 1 to 18, comprising forming black, yellow, magenta, and cyan toner images, and the toner image that provides a metallic effect, on the receiver material using at least five sequential toner printing stations in a color electrophotographic printing machine.

20. A printed receiver material provided by the method of any of embodiments 1 to 19, comprising a printed image comprising fused metallic dry toner particles that provide a metallic effect and a fused color toner in the printed image, wherein, before fixing:

(a) each metallic dry toner particle has a mean volume weighted diameter ($D_{vol}$) before fixing of at least 15 μm and up to and including 40 μm, (b) at least 50 weight % of the total non-conductive metal oxide particles within metallic dry toner particles have an aspect ratio of at least 5 and an ECD of at least 2 μm and up to and including 50 μm, (c) the non-conductive metal oxide particles are present in an amount of at least 15 weight % and up to and including 50 weight %, based on total metallic dry toner particle weight, (d) the ratio of the metallic dry toner particle $D_{vol}$ to the average equivalent circular diameter (ECD) of the non-conductive metal oxide particles in the metallic dry toner particles, before fixing, is greater than 0.1 and up to and including 10, (e) the non-conductive metal oxide particles consist essentially of: (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 30 nm and up to and including 700 nm so that the total average dry thickness of all oxide layers is at least 30 nm and up to and including 1400 nm, and (f) at least one of the layers of an oxide of iron, chromium, silicon, titanium, or aluminum, forms the outermost layer of the non-conductive metal oxide particles.

The following Examples are provided to illustrate the practice of this invention and are not meant to be limiting in any manner.

For each example, a mixture of toner particle ingredients were dry blended as a powder in a 40 liter Henschel mixer for 60 seconds at 1000 RPM to produce a homogeneous blend. A bisphenol-A based polyester from Reichhold Chemicals Corporation, commercially available as Atlac 382ES, was used as the polymeric binder that was dry blended with 2 pph of Orient Chemicals Bontron E-84 charge control agent. The metal oxide particles were also added to the dry blend in the range of 20 weight % to 60 weight %, based on the total dry blend weight.

Each powder dry blend was then melt compounded (extruded) in a twin screw co-rotating extrusion device to melt the dry blend and to uniformly disperse the non-conductive metal oxide particles, charge control agents, and waxes. Melt compounding was done in the extrusion device at a temperature of 110° C. at the extruder inlet, 110° C. increasing to 196° C. in the extruder compounding zones, and 196° C. at the extruder die outlet. The processing conditions were a dry blend feed rate of 10 kg/hr and an extruder screw speed of 490 RPM, and a draw down ratio of 3 in the same direction that the extrusion composition was removed from the extrusion device. The cooled extrudate was then chopped to approximately 0.3 cm size granules.

After melt compounding, these granules were then fine ground in an air jet mill to the desired toner particle sizes. The metallic dry toner particle size distribution was measured with a Coulter Counter Multisizer and reported as mean volume weighted diameter ($D_{vol}$). The fine ground metallic dry toner particles were then classified in a centrifugal air classifier to remove very small metallic dry toner particles and metallic dry toner fines that were not desired in the finished product. After this classification, the metallic dry toner particles had a particle size distribution with a width, expressed as the diameter at the 50% percentile/diameter at the 16% percentile of the cumulative particle number versus particle diameter, of 1.30 to 1.35.

The resulting mixtures pulverized to yield two metallic dry toner particles of sizes about 14 μm and about 21 μm mean volume weighted diameter ($D_{vol}$). The metallic dry toner particles were then surface treated with fumed silica particles, a hydrophobic silica (T810G, manufactured by Cabot Corporation) and large hydrophobic silica particles (Aerosil® NY50, manufactured by Nippon Aerosil) were used. For this surface treatment 2000 grams of metallic dry toner particles were mixed with 0.3 weight % of TG810G or 1% of NY50 to give a product containing different weight % of each silica particles. The metallic dry toner particles and silica particles were mixed in a 10 liter Henschel mixer with a 4 element impeller for 2 minutes at 2000 RPM. Careful attention was paid to ensure that the larger metallic dry toner particles did not create fines by breaking up during the surface treatment process owing to their large mass. A 21 μm $D_{vol}$ metallic dry toner particle has nearly 20 times the mass of an 8 μm $D_{vol}$ metallic dry toner particle while a 28 μm $D_{vol}$ metallic dry toner particle is almost 42 times heavier. It is thus important that care is taken during the materials handing step, so that generation of fine or smaller particles is minimized.

The silica surface treated metallic dry toner particles were sieved through a 230 mesh vibratory sieve to remove non-dispersed silica agglomerates and any toner flakes that may have formed.

The various metallic dry toner particle products are identified below in TABLE I below, along with the various metal oxides or pigments and additives that were used in their preparation. The inventive metallic dry toner particles contained non-conductive metal oxides obtained as various commercial products as shown in the second column of TABLE I. Ester wax WE3 is an ester wax that was obtained from NOF Corporation (Japan). The "gold" pigment used in Comparative Example C-11 was Iriodin® 305 Solar Gold that was obtained from EMD Chemicals (New Jersey). PY139 used in Invention Example I-10 was Pigment Yellow 139 (or 11-4002 Novaperm Yellow PM3R) that was obtained from Clariant Corporation (Rhode Island). The pearlescent pigment used in Invention Examples 1-13 through 1-15 was Iriodin® 123 Bright Luster Satin that was obtained from EMD Chemicals. The carbon black pigment used in Invention Example 1-15 was Black Pearls 330 that was obtained from Cabot Corporation (Massachusetts) and PB 61 is Pigment Blue 61 (or Sunbrite Blue 61) that was obtained from Sun Chemicals (Ohio).

TABLE I

| Example | Metal Oxide/ Additive(s) | Metal Oxide/Additive Amounts * (weight %) | Toner Particle $D_{vol}$ (μm) | Metallic Effect |
|---|---|---|---|---|
| Comparative C-1 | EMD Iriodin ® 305 | 20 | 14 | Unsatisfactory |
| Comparative C-2 | EMD Iriodin ® 305 | 30 | 14 | Unsatisfactory |
| Comparative C-3 | EMD Iriodin ® 305 | 40 | 14 | Unsatisfactory |

TABLE I-continued

| Example | Metal Oxide/ Additive(s) | Metal Oxide/Additive Amounts * (weight %) | Toner Particle $D_{vol}$ (μm) | Metallic Effect |
|---|---|---|---|---|
| Invention I-4 | EMD Iriodin ® 305 | 20 | 22 | Some metallic appearance |
| Invention I-5 | EMD Iriodin ® 325 | 30 | 22 | Good |
| Invention I-6 | EMD Iriodin ® 305 | 30 | 22 | Good |
| Comparative I-7 | EMD Iriodin ® 305WM10 | 30 | 21 | Good |
| Invention I-8 | EMD Iriodin ® 305 | 40 | 22 | Good |
| Invention I-9 | EMD Iriodin ® 305/ Ester Wax WE3 | 30/5 (wax) | 22 | Good |
| Invention I-10 | EMD Iriodin ® 305/ PY 139 | 40/0.2 (PY 139) | 22 | Good |
| Comparative C-11 | "Gold" | 60 | Failed | |
| Invention I-12 | Iriodin ® 123 | 20 | 22 | Some metallic appearance |
| Invention I-13 | Iriodin ® 123 | 30 | 21 | Good |
| Invention I-14 | Iriodin ® 123 | 40 | 22 | Good |
| Invention I-15 | Iriodin ® 123/Carbon Black/PB 61 | 40/0.3/0.13 | 21 | Good |

* Based on total metallic dry toner particle weight

Dry electrophotographic two-component developers were prepared by mixing metallic dry toner particles having the compositions described above with carrier particles. These two-component developers were made at a concentration of 10 weight % metallic dry toner particles, and 90 weight % carrier particles. The carrier particles were hard magnetic ferrite carrier particles coated with mixture of poly(vinylidene fluoride) and poly(methyl methacrylate).

The dry two-component developers were used in separate experiments in a NexPress™ 3000 printer equipped with 5 electrophotographic modules. The two-component developers were loaded into the $5^{th}$ module following the CYMK color toner modules. Various color toner images were prepared on sheets of paper (receiver materials) using the metallic dry toner particles to provide a metallic effect, if possible, that was subjectively evaluated by holding and tilting the color toner images against a light source. The "flop" or degree of luster (sparkle or metallic effect) was determined and is reported in TABLE I above. The evaluation "unsatisfactory" means that there was insufficient luster (sparkle) in the resulting color toner image. A "good" evaluation means that the desired luster (sparkle) was observed in the resulting color toner image.

It was found that when the metallic dry toner particles contained less than 20 weight % of non-conductive metal oxide particles, there was poor or no luster in the color toner image. An "unsatisfactory" result was produced in color toner images using metallic dry toner particles having a $D_{vol}$ of less than 15 μm. The optimum metallic effect and sparkle were achieved when the amount of the non-conductive metal oxide particles in the metallic dry toner particles was from 20 weight % to and including 50 weight % and the $D_{vol}$ was greater at least 15 μm. At a non-conductive metal oxide particle concentration of 60 weight % or more (for example Comparative C-11), there is too little polymeric binder phase to compound the non-conductive metal oxide particles properly.

The metallic dry toner particles prepared in Comparative C-7 provided good metallic effect in a fixed toner image, but they did not perform well as toner particles in the electrophotographic process. These metallic dry toner particles contained non-conductive metal oxide particles that included about 30% by weight of a semi-crystalline aliphatic polymer coating over the metal oxide layers that were disposed on the mica substrate. Thus, the aliphatic polymer coating formed the outermost surface of the non-conductive metal oxide particles. This organic outermost layer adversely affected both the triboelectric charge properties and the powder-like flow of the metallic dry toner particles. It was also found that these aliphatic polymers separated from metal oxide layers in the metal oxide particles and migrated to the surface of the toned image after toner fusing and then contaminated any surfaces with which the toned image came in contact.

Metallic dry toner particles described herein were used to prepare dry developers and used to print images using a NexPress 3000 Digital Color Press. Various weights of these metallic dry toner particles were developed and fixed on both a non-imaged receiver material and over dry color toners (images) on a receiver material. As summarized below in TABLE II, the maximum metallic appearance was provided when the amount of metallic dry toner particles having a $D_{vol}$ of 22 μm, was less than 1 mg/cm$^2$. For particle with a $D_{vol}$ of 22 μm, a maximum of metallic appearance was found to exist at a lay down of from 0.7 to 0.9 mg/cm$^2$ for the metallic dry toner particles. At lower lay down, the metallic appearance was diminished, but when the metallic dry toner particles developed and fixed over dry color toners, a myriad of different metallic effects (hues or sparkle) could be produced. Particularly good results were obtained when the metallic dry toner particles described herein were developed and fixed over the CYMK dry color toners.

For transparent metallic dry toner particles described herein, different effects were produced when they were developed and fixed over or under the dry color toner images. However, the maximum metallic effect was observed when the lay down was less than 1 mg/cm$^2$ for the metallic dry toner particles having a $D_{vol}$ of 22 μm.

TABLE II

| Example | Metallic Dry Toner Particles | Lay down (mg/cm$^2$) | Image Appearance (Effect) |
|---|---|---|---|
| 1 | Invention I-9 | 0.1 | Little Metallic |
| 2 | Invention I-9 | 0.2 | Little Metallic |
| 3 | Invention I-9 | 0.3 | Increasing Metallic |
| 4 | Invention I-9 | 0.4 | Increasing Metallic |
| 5 | Invention I-9 | 0.5 | Increasing Metallic |
| 6 | Invention I-9 | 0.6 | Increasing Metallic |
| 7 | Invention I-9 | 0.7 | Most Metallic |
| 8 | Invention I-9 | 0.8 | Most Metallic |
| 9 | Invention I-9 | 0.9 | Most Metallic |
| 10 | Invention I-9 | 1.0 | Reduced Metallic |
| 11 | Invention I-9 | 1.1 | Reduced Metallic |
| 12 | Invention I-9 | 1.2 | Reduced Metallic |
| 13 | Invention I-9 | 1.5 | Reduced Metallic |
| 14 | Invention I-9 | 2.0 | Dull Metallic |
| 15 | Invention I-9 | 2.5 | Matte |
| 16 | Invention I-13 | 0.1 | Little Metallic |
| 17 | Invention I-13 | 0.2 | Little Metallic |
| 18 | Invention I-13 | 0.3 | Increasing Metallic |
| 19 | Invention I-13 | 0.4 | Increasing Metallic |
| 20 | Invention I-13 | 0.5 | Increasing Metallic |
| 21 | Invention I-13 | 0.6 | Increasing Metallic |
| 22 | Invention I-13 | 0.7 | Most Metallic |
| 23 | Invention I-13 | 0.8 | Most Metallic |
| 24 | Invention I-13 | 0.9 | Most Metallic |
| 25 | Invention I-13 | 1.0 | Reduced Metallic |
| 26 | Invention I-13 | 1.1 | Reduced Metallic |
| 27 | Invention I-13 | 1.2 | Reduced Metallic |
| 28 | Invention I-13 | 1.5 | Reduced Metallic |
| 29 | Invention I-13 | 2.0 | Dull Metallic |
| 30 | Invention I-13 | 2.5 | Matte |

The invention has been described in detail with particular reference to certain preferred embodiments thereof, but it will be understood that variations and modifications can be effected within the spirit and scope of the invention.

The invention claimed is:

1. A method for providing a color image with a metallic effect, the method comprising:

forming one or more latent images, developing the one or more latent images with non-conductive metallic dry toner particles and color toner particles to form a developed color toner image with a metallic effect, transferring the developed color toner image with a metallic effect to a receiver material to form a transferred developed color toner image with a metallic effect, and fixing the transferred developed color toner image with a metallic effect to the receiver material, wherein each non-conductive metallic dry toner particle consists essentially of a polymeric binder phase and non-conductive metal oxide particles dispersed within the polymeric binder phase and each non-conductive metallic dry toner particle is free of additional colorants, wherein, before fixing:

(a) each non-conductive metallic dry toner particle has a mean volume weighted diameter ($D_{vol}$) of at least 15 μm and up to and including 40 μm and an aspect ratio of at least 2 and up to and including 10, (b) at least 50 weight % of the total non-conductive metal oxide particles within the non-conductive metallic dry toner particles have an aspect ratio of at least 5 and an ECD of at least 2 μm and up to and including 50 μm, (c) the non-conductive metal oxide particles are present in an amount of at least 20 weight % and up to and including 50 weight %, based on total non-conductive metallic dry toner particle weight, (d) the ratio of the non-conductive metallic dry toner particle $D_{vol}$ to the average equivalent circular diameter (ECD) of the non-conductive metal oxide particles in the non-conductive metallic dry toner particles, before fixing, is greater than 0.1 and up to and including 10, (e) the non-conductive metal oxide particles consist essentially of: (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 30 nm and up to and including 700 nm so that the total average dry thickness of all oxide layers is at least 30 nm and up to and including 1400 nm, and (f) at least one of the layers of an oxide of iron, chromium, silicon, titanium, or aluminum, forms the outermost layer of the non-conductive metal oxide particles.

2. The method of claim 1, wherein the color toner particles comprise a polymeric binder phase and a cyan, yellow, magenta, or black colorant dispersed within the polymeric binder phase.

3. The method of claim 1, comprising:

forming the toner image that provides a metallic effect on the receiver material with the non-conductive metallic dry toner particles, then forming a cyan, yellow, magenta, or black toner image over the toner image that provides a metallic effect, with the color toner particles, and fixing both the toner image that provides a metallic effect and the cyan, yellow, magenta, or black toner image to the receiver material.

4. The method of claim 1, comprising:

forming a cyan, yellow, magenta, or black toner image on a receiver material, then forming the toner image that provides a metallic effect over the cyan, yellow, magenta, or black toner image, and fixing both the cyan, yellow, magenta, or black image and the toner image that provides a metallic effect to the receiver material.

5. The method of claim 1, comprising:

forming, in any sequence, cyan, yellow, magenta, and black toner images on a receiver material, then forming the toner image that provides a metallic effect over the cyan, yellow, magenta, and black toner images, and fixing all of the cyan, yellow, magenta, and black toner images, and the toner image that provides a metallic effect to the receiver material.

6. The method of claim 1, comprising:

forming, the toner image that provides a metallic effect on the receiver material, then forming in this sequence, black, yellow, magenta, and cyan toner images over the toner image that provides a metallic effect, and fixing all of the black, yellow, magenta, and cyan toner images, and the toner image that provides a metallic effect to the receiver material.

7. The method of claim 1, comprising:

forming in this sequence, black, yellow, and magenta toner images on the receiver material, then forming the toner image that provides a metallic effect over the black, yellow, and magenta toner images, then forming a cyan toner image over the toner image that provides a metallic effect and the black, yellow, and magenta toner images, and fixing all of the black, yellow, and magenta toner images, the toner image that provides a metallic effect, and the cyan toner image, to the receiver material.

8. The method of claim 1, wherein the lay down of the non-conductive metallic dry toner particles in the toner image that provides a metallic effect is defined by the equation, in $mg/cm^2$:

$$\text{Lay down} \leq [0.06 \times D_{vol}].$$

9. The method of claim 1, wherein the non-conductive metal oxide particles consist essentially of: (i) a silica, alumina, or mica substrate having an outer surface, and (ii) disposed on at least part of the substrate outer surface, one or more layers of an oxide of iron, chromium, silicon, titanium, or aluminum, each of the one or more layers having an average dry layer thickness of at least 60 nm and up to and including 300 nm so that the total average dry thickness of all oxide layers is at least 60 nm and up to and including 600 nm.

10. The method of claim 1, wherein the non-conductive metal oxide particles consist essentially of: (i) a silica, alumina, or mica substrate having an outer surface, and (ii) disposed on at least part of the substrate outer surface, two layers of different oxides of iron, chromium, silicon, titanium, or aluminum, each of the two layers having an average dry layer thickness of at least 60 nm and up to and including 300 nm so that the total average dry thickness of both oxide layers is at least 60 nm and up to and including 600 nm.

11. The method of claim 1, wherein at least one dry layer disposed on the silica, alumina, or mica substrate comprises titanium dioxide, ferric oxide, or chromium oxide, or mixtures thereof.

12. The method of claim 1, wherein the non-conductive metal oxide particles consist essentially of a mica substrate having an outer surface, and a titanium dioxide layer, ferric oxide layer, or both a titanium dioxide layer and a ferric oxide layer disposed on at least part of the substrate outer surface.

13. The method of claim 1, wherein a silane is disposed on the outer surface of the non-conductive metal oxide particles in an amount of up to 5% based on the total weight of the non-conductive metal oxide particles.

14. The method of claim 1, wherein the ratio of the non-conductive metallic dry toner particle $D_{vol}$ to the average equivalent circular diameter (ECD) of the non-conductive metal oxide particles in the non-conductive metallic dry toner particles, before fixing, is greater than 0.1 and up to and including 5.

15. The method of claim 1, wherein the non-conductive metallic dry toner particles have an aspect ratio of at least 3.

16. The method of claim 1, wherein the non-conductive metallic dry toner particles further comprise, on their outer surface, a fuser release aid, flow additive particles, or both of these materials.

17. The method of claim 1, wherein the receiver material is a sheet of paper or a polymeric film.

18. The method of claim 1, comprising forming cyan, yellow, magenta, and black toner images, and the toner image that provides a metallic effect, on the receiver material using at least five sequential toner printing stations in a color electrophotographic printing machine.

* * * * *